US010907838B2

(12) United States Patent
Ghelli et al.

(10) Patent No.: US 10,907,838 B2
(45) Date of Patent: Feb. 2, 2021

(54) ENERGY EFFICIENT ELECTRIC COOKER

(71) Applicant: King Abdulaziz University, Jeddah (SA)

(72) Inventors: Alessandro Ghelli, Colchester (GB); Hani Hagras, Colchester (GB); Daniyal Alghazzawi, Colchester (GB); Aysenur Bilgin, Colchester (GB); Ghadah Aldabbagh, Jeddah (SA)

(73) Assignee: King Abdulaziz University, Jeddah (SA)

( * ) Notice: Subject to any disclaimer, the term of this patent is extended or adjusted under 35 U.S.C. 154(b) by 707 days.

(21) Appl. No.: 15/570,823

(22) PCT Filed: Nov. 30, 2015

(86) PCT No.: PCT/IB2015/002272
§ 371 (c)(1),
(2) Date: Oct. 31, 2017

(87) PCT Pub. No.: WO2016/087921
PCT Pub. Date: Jun. 9, 2016

(65) Prior Publication Data

US 2018/0135863 A1 May 17, 2018

(30) Foreign Application Priority Data

Dec. 2, 2014 (GB) ..... 1421419.1

(51) Int. Cl.
*H05B 1/02* (2006.01)
*F24C 7/08* (2006.01)

(52) U.S. Cl.
CPC ..... *F24C 7/083* (2013.01); *H05B 1/0266* (2013.01); *H05B 2213/07* (2013.01)

(58) Field of Classification Search
CPC ..... F24C 7/083; H05B 1/02; H05B 1/0266; H05B 1/0261; H05B 3/0076; H05B 2213/07
(Continued)

(56) References Cited

U.S. PATENT DOCUMENTS 6,118,105 A 9/2000 Berkcan et al.
8,793,004 B2 * 7/2014 Grichnik ..... G05B 23/0235 700/30
(Continued)

FOREIGN PATENT DOCUMENTS

EP 2 582 202 A1 4/2013
JP 2010 244998 A 10/2010
(Continued)

OTHER PUBLICATIONS

International Search Report and Written Opinion for corresponding Patent Application No. PCT/IB2015/002272 dated Jun. 1, 2016.
International Preliminary Report on Patentability Chapter I for corresponding Patent Application No. PCT/IB2015/002272 dated Jun. 6, 2017.

*Primary Examiner* — Mark H Paschall
(74) *Attorney, Agent, or Firm* — Renner, Otto, Boisselle & Sklar, LLP

(57) ABSTRACT

A cooker hotplate control system, to heat to and maintain a foodstuff at a preset temperature the system comprising an electric hotplate; a power input to provide electricity to heat the hot plate and a controller to govern said power input; a temperature sensor to determine the temperature of the hotplate; an infrared sensor spatially separated from and to detect infrared radiation emitted by a foodstuff or a vessel containing a foodstuff on the hotplate; a first processor to determine the temperature of a foodstuff or a vessel from the detected infrared radiation and a first data storage means to store said data; a second processor, the second processor calculating the first and second time derivatives of the
(Continued)

temperature data; a first fuzzy logic controller receiving as input the first and second time-derivative data from the second processor and producing an output to the controller, said output governing the amount of power supplied to the hotplate, the first fuzzy logic controller being active to bring a foodstuff temperature up to the pre-set temperature and to hold a foodstuff at the pre-set temperature for a defined time period; a second fuzzy logic controller to maintain the temperature within a defined temperature range about the pre-set temperature.

30 Claims, 44 Drawing Sheets

(58) Field of Classification Search
USPC ..... 219/492, 491, 497, 494, 506, 446.1, 219/448.12, 448.13, 448.11
See application file for complete search history.

(56) References Cited

U.S. PATENT DOCUMENTS

2005/0247696 A1* 11/2005 Clothier ..... H05B 6/1209 219/497
2012/0000904 A1* 1/2012 Hashimoto ..... H05B 6/062 219/622
2015/0282255 A1* 10/2015 Christiansen ..... H05B 6/062 219/627

FOREIGN PATENT DOCUMENTS

JP 2010 282860 A 12/2010
WO 97/19394 5/1997
WO 2011/132614 A1 10/2011

* cited by examiner

| Dimming Output | | 2nd Derivative of the IR sensed temperature | | |
|---|---|---|---|---|
| | | Increase | Steady | Decrease |
| 1st Derivative of the IR sensed temperature | Positive | Max | Max | Max |
| | Steady | Medium Low | Min | Medium Low |
| | Negative | Medium High | Max | Max |

FIG. 6A

| Dimming Output | | 1st Derivative of the Temperature Deviation from the Target | | |
|---|---|---|---|---|
| | | Increase | Steady | Decrease |
| Temperature Deviation from the Target | Positive | OFF/Zero | Min | Min |
| | Zero | Min | OFF | Medium Low |
| | Negative | Medium Low | Medium High | Max |

FIG. 6B

| Temperature Difference Between the IR and TC Sensors | Scaling Output |
|---|---|
| Low | Full Scaling |
| High | Zero Scaling |

FIG. 6C

| Black/Teflon | Metal/Steel/Aluminum | White/Ceramic |
|---|---|---|
| 0.96 | 0.5 | 0.75 |

FIG. 9B

| Corn Oil | Peanut Oil | Sunflower Oil | Lard | Olive Oil | Extra Virgin Olive Oil | Soybean Oil | Butter |
|---|---|---|---|---|---|---|---|
| 0.94 | 0.94 | 0.94 | 0.92 | 0.96 | 0.9 | 0.91 | 0.9 |

FIG. 9C

| Dimming Output | | 1st Derivative of the Deviation of the IR Sensed Temperature Value from the Target | | |
|---|---|---|---|---|
| | | Increase | Steady | Decrease |
| Deviation of the IR Sensed Temperature Value from the Target | Positive | OFF/Zero | OFF/Zero | OFF/Zero |
| | Zero | OFF/Zero | Min | Medium Low |
| | Negative | Medium High | Max | Max |

FIG. 12C

| TC Temperature | Dimmer Output |
|---|---|
| Low | Max |
| Medium | Min |
| High | OFF/Zero |

| | Boiling | Stir-Frying | Deep-Frying |
|---|---|---|---|
| Average Energy Saving | 21.42% | 34.43% | 20.29% |
| Standard Deviation of Energy Savings | 3.7 | 5.2 | 2.7 |

FIG. 16

Experience Adaptation Application

Preparation time in your opinion
How long did the recipe take to prepare?
- Extremely short
- Very short
- Short
- Long
- Very long
- Extremely long Cooking time in your opinion
How quick did the recipe take to cook?
- Extremely quick
- Very quick
- Quick
- Slow
- Very slow
- Extremely slow Difficulty level in your opinion
How did you find the difficulty of the recipe?
- Extremely easy
- Very easy
- Easy
- Challenging
- Very challenging
- Extremely challenging Customize
Would you cook this recipe again?
- Yes
- No Submit Feedback & Open Survey Please leave your feedback using the menu on the left...

Dish Name: Pasta with tomato and onion sauce

Preparation time. 1.0 minutes

Cooking time: 20.0 minutes

Difficulty: extremely easy

Calories. 275 kcal

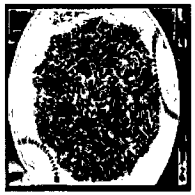

Ingredients:
15 gr butter or margarine
400 ml cold water
Tesco Tomato and onion pasta sachet Directions:
1. Place the pot on the hob.
2. Pour cold water in the pot, add margarine or butter.
3. Bring to boil
4. Stir the contents of the sachet into the liquid. Simmer gently for about 8-10 minutes, stirring occasionally, or until the pasta is tender and the sauce is of the desired consistency.
5. Remove from the heat, stir and serve. The sauce will thicken on standing.

*No personal notes

Figure 23b

ENERGY EFFICIENT ELECTRIC COOKER

This application is a national phase of International Application No. PCT/162015/002272 filed Nov. 30, 2015 and published in the English language, which claims priority to United Kingdom Patent Application No. 1421419.1 filed Dec. 2, 2014, which are hereby incorporated herein by reference.

FIELD OF THE INVENTION

The present invention relates to an energy efficient cooker. In particular a device and methodology are disclosed to enable a cooker to need to operate less under full load and also to cook semi-autonomously. Fuzzy logic is employed to assist in the control of the heating elements and to ensure the safety and autonomy of cooking. General Type-2 fuzzy Logic systems are also developed to allow computing with words.

BACKGROUND TO THE INVENTION

Energy efficiency in domestic buildings is gaining increasing attention as it is estimated that buildings contribute up to 30% of the global annual greenhouse gas emissions and consume up to 40% of the supplied energy. Hence, improving the energy efficiency of domestic buildings has the potential for delivering significant cost-effective energy and greenhouse gas emission reductions. It is estimated that electric appliances and lighting make up 11% of the sector's total energy consumption. Hence, recently, homes have been equipped with smarter and more energy efficient electric appliances. However, electric cookers lack the level of intelligence and energy efficiency that exist in other household appliances even though electric cookers are heavy energy consuming devices (in the UK, electric cookers can consume up to 20% of the evening peak electricity consumption). In addition, cookers can cause major house accidents and fires and half of accidental house fires are due to cooking and cooking appliances. Furthermore, wrong use of cookers can cause health risks where for instance non-stick pots/pans have a maximum temperature that must not be reached (about 250° C.) to prevent toxic chemical changes in the non-stick surface. However, unlike the oven (which is a closed space); thermal conditions pertaining to the hot-plates on a cooker can vary significantly which makes the energy efficient control of the various cooking techniques a challenging task.

There exist various advanced cookers such as induction cookers which represent an energy efficient technology, but induction cookers require special pots and can moreover cause electromagnetic emissions which can cause health risks, such as interfering with heart pacemakers. Such cookers can be controlled through a touch-panel, can provide up to 17 levels of heat and can also switch-off when liquids are spilled on the cooker-top. Some cookers can detect the size of the pan and adapt the heating accordingly where producers have predefined different heating levels according to the pan size. The Whirlpool 6th Sense™ cooker can automatically bring water to the boiling point and then adjust heating to maintain the boiling. Unfortunately a long list of limitations (e.g. requiring the use of pots/pans with specific bottom diameter and not permitting the use of lids) reduces the appeal of this interesting feature. The iQcook TM induction hob is a product which employs mathematical modelling to enable some intelligent features like the ability to automatically control the operation of some cooking techniques. However, the iQcook TM as an induction cooker cannot use any type of pots/pans (like aluminium, copper or ceramic pots/pans), cannot boil food without lids and needs a sensor attached to the lid. In addition, stir/shallow frying cannot be performed or risky situations like pots boiling dry detected. Hence, these products remain expensive options, requiring the purchase of new cooking apparatus and do not provide the needed autonomy, energy efficiency and safe operation.

There have been several research efforts to exploit pervasive sensor infrastructures to guide users through cooking recipes. Ontologies dedicated to the process of cooking for human-machine dialogue systems were also built in. However, these systems require the kitchen to be filled with a large number of expensive sensors, cameras and some systems even require tags to be attached to the food. Furthermore, these systems do not save energy or try to reduce the risks associated with cooking.

Few researchers have investigated the possibility of developing semi-autonomous cookers. Terai et al. (IEEE, 20(4), 956-60, 1984) disclosed electric cookers capable of detecting when a liquid reaches boiling. However the developed system is slow in detecting that boiling has commenced (up to two minutes). Bosch and Siemens developed a cooker equipped with an Infra-Red (IR) temperature sensor which could enable the needed temperatures to boil, simmer, deep-fry, warm to be reached and to cook food through a pressure cooker. The major limitation is that the system relies completely on the temperature value returned by the IR sensor. Such sensors however cannot sense the real temperature of an object, but the temperature scaled by a parameter called emissivity. The emissivity changes its value according to the material of the sensed object, its colour, the surface finishing and many other parameters. This means that the control works properly only when the emissivity of the system is known in advance, of the combined pot/pan, food and the water/oil used for cooking: something which is almost impossible to know beforehand. To overcome this issue, it was proposed to cover the pan sides with a special tape of known emissivity which is not a practical solution for everyday use.

Researchers from the University of Zaragoza have disclosed systems which can automate some cooking processes wherein a large dataset was built comprising the measurements of the characteristics of several types of induction cookers and pans and they derived an elaborated mathematical model of the cooking system (Proceedings of the 18th Mediterranean Conference on Control Automation, Marrakesh, Morocco, June 2010, pp. 298-303). Exploiting this model and a negative temperature coefficient (NTC) sensor placed just below the induction cooker covering glass, a controller that possibly allows semi-automatic cooking is utilised. However, the system is not fully reliable during transients and when a user fills a pan with a large volume of water. The use of two simmering controllers, still based on mathematical models of the system and the temperature of the system using an IR temperature sensor as per the Bosch and Siemens' system above was proposed, but again it has the problem of dealing with the unknown emissivity of a pan/pot and its contents.

In a previous paper by the inventor a methodology is disclosed in which the emissivity of the system is utilized in conjunction with the time derivatives of temperature measurement to control the heat supplied to foodstuffs through an electric plate.

The present invention seeks to address the problems of the prior art by providing a fuzzy logic-based system. The system can be installed as part of a new cooker or retrofit to an existing cooker to convert same into semi-autonomous, energy efficient and safe smart electric cookers. The proposed system allows the safe semi-autonomous operation of various cooking techniques including boiling, stir/shallow-frying, deep-frying and warming. In addition, an energy saving over conventional cookers is to be achieved.

SUMMARY OF THE INVENTION

According to a first aspect of the invention there is provided a cooker hotplate control system, to heat to and maintain a cooking medium comprising water and/or a foodstuff distributed in water at or around the boiling point of water when using an electric hotplate, the system comprising;

a dimmer to govern power input to an electric hotplate to heat a hotplate;

a temperature sensor to determine the temperature of a hotplate;

an infrared sensor spatially separated from and to detect infrared radiation emitted by a cooking medium or a vessel containing a cooking medium on a hotplate;

a first processor to determine the temperature of a cooking medium or a vessel from the detected infrared radiation and a first data storage means to store said data;

a second processor, the second processor calculating the first and second time derivatives of the temperature data;

a first fuzzy logic controller receiving as input the first and second time-derivative data from the second processor and producing an output to the dimmer, said output governing the amount of power supplied to a hotplate, the first fuzzy logic controller being active to bring a cooking medium temperature up to the boiling point and to hold a cooking medium at the boiling point for a defined time period.

The system provides a semi-autonomous cooker which has reduced energy usage compared with conventional cookers.

Parameters of the first fuzzy logic controller are advantageously determined within the first 30 seconds of heating with power to the hotplate set to full. This enables the system to be flexible in dealing with different vessels, volumes of liquid.

The system preferably includes a laser distance detector to detect the presence of a vessel on the hotplate. This enables power to the hotplate to be switched off and so minimize energy wastage.

The infrared sensor is optionally set at a distance of 25 to 35 cm from a vessel on the hotplate and further optionally around 30 cm to allow for a good reading of the emission but not to interfere with the cooking process.

Advantageously the second fuzzy logic controller is activated only when the first temperature time derivative is steady for a preset period, said preset period advantageously being 30 s.

The output of the first or second fuzzy logic controller is optionally supplied to a fuzzy logic system whose output governs the power supply controller, which output has two levels, full or zero.

Advantageously, the fuzzy logic system acts to maintain a temperature differential of 100 to 120° C. between the hotplate temperature and a cooking medium on the hotplate.

Preferably the fuzzy logic system acts to maintain a temperature difference of 30-50° C. between a hotplate temperature and a cooking medium on the hotplate and further preferably the dimmer provides zero power to the hotplate when the temperature difference is greater than 50° C.

Optionally, the first fuzzy logic system is activated and the second fuzzy logic controller is deactivated if the temperature is more than 15° C. below the boiling point Preferably the hotplate temperature sensor measures the temperature of a lateral edge of the hotplate, which minimizes the separation the sensor causes between the hotplate and the base of a vessel.

The system advantageously includes a warning means should the hotplate temperature be greater than 40° C. to reduce the risk of a user injuring himself.

Control of the system by a user is preferably through a graphic user interface.

Preferably, a user communicates with the system through voice commands and a computing with words architecture, the commands further preferably being processed using linear general type-2 fuzzy logic methodology. Yet further preferably, a general Type-2 fuzzy logic methodology is used.

Fuzzy logic controllers and the fuzzy logic system are advantageously mamdani fuzzy logic controllers and fuzzy logic systems employing a maximum inference and a centre of sets and de-fuzzification.

Preferably the system includes a power cut-out means in the event the temperature of a foodstuff is determined to be greater than 250° C. Optionally the system includes a power cut-out in the event the temperature determined by the infrared sensor exceeds 105° C. The system further optionally includes a buffer to store the most recent temperature determinations to check if a rapid increase in temperature is occurring, said buffer further optionally containing the previous twenty temperature determinations. The system can therefore react quickly to a boil-dry situation.

According to a second aspect of the invention there is provided a cooker hotplate control system to heat to and maintain a cooking medium comprising a cooking oil and/or a foodstuff distributed in an oil at or around a requested frying temperature when using an electric hotplate, the system input means enabling a user to input a cooking oil or vessel type and a desired cooking temperature;

a dimmer to govern power input to an electric hotplate to heat a hotplate;

a temperature sensor to determine the temperature of a hotplate;

an infrared sensor spatially separated from and to detect infrared radiation emitted by a cooking medium or a vessel containing a cooking medium on a hotplate;

the system including a look-up table of emissivity values for vessels and for cooking oils, which values are processed by the first processor to determine the actual temperature of a foodstuff;

a first processor to determine the actual temperature of a cooking medium or a vessel from the detected infrared radiation and a first data storage means to store the actual temperature;

a second processor to calculate the difference between the frying temperature and the actual temperature;

a third processor calculating the first time derivative of the temperature difference data obtained from the second processor;

a first fuzzy logic controller receiving as input the first time-derivative data from the third processor and the output of the second processor;

and producing an output to the dimmer, said output governing the amount of power supplied to a hotplate, the first fuzzy logic controller being active to bring a cooking medium temperature up to the frying temperature and to hold a cooking medium at the frying temperature for a defined time period;

a data storage module to store the target temperature of the hotplate when a cooking medium reaches the frying temperature;

a second fuzzy logic controller to maintain the temperature of a cooking medium within a defined temperature range about the frying temperature the second fuzzy logic controller receiving as input the target temperature and producing an output to the dimmer, said output governing the amount of power supplied to a hotplate;

the first and second fuzzy logic systems acting sequentially.

The system provides a semi-autonomous cooker which has reduced energy usage compared with conventional cookers and also reduces the risk of accidents occurring which are not uncommon when cooking with cooking oil.

Optionally, the system includes a power cut-out means in the event the temperature of a cooking medium is determined to be greater than 250° C.

Preferably the system further includes a buffer to store the most recent temperature determinations to check if a rapid increase in temperature is occurring, said buffer further preferably containing the previous twenty temperature determinations.

Optionally, the hotplate temperature sensor measures the temperature of a lateral edge of a hotplate.

Advantageously the system includes a warning means should a hotplate temperature be greater than 40° C. to reduce the risk of a user injuring himself.

Optionally, control of the system by a user is through a graphic user interface.

Preferably, a user communicates with the system through voice commands and a computing with words architecture, said commands further preferably being processed using linear general type-2 fuzzy logic methodology and especially preferably a general Type-2 fuzzy logic methodology is used.

According to a third aspect of the invention there is provided a system to govern communication with a computer, the system comprising;

input means enabling a user to input linguistic variables into a register;

a first processing module having a first database of descriptors and antonyms of said descriptors and a comparator to compare the linguistic variable input in the register, against the elements of the database, a second database of descriptor and antonym modifiers, a third database comprising actions, each action associated with an action numerical value;

a communication means;

the input of the first processing module comprising a linguistic variable selected from the first database and the output of the first processing module being a numerical output, the numerical output being a secondary membership function incorporated into a linear general type-2 fuzzy set;

a second processing module receiving input from the first processing module, the second processing module combining inputs received from the first processing module to produce an output;

the output of the second processing module comprising an action numerical value, the action numerical value being passed to a second comparator to associate the action numerical value with an action, the communication means communicating the action to a user.

BRIEF DESCRIPTION OF THE DRAWINGS

The invention is now described with reference to the accompanying drawings which show by way of example two embodiments of a control system. In the drawings:

FIGS. 6*a* to 6*c* are rulebases for respectively FLC(1), FLC(2) and FLS(3);

FIG. 9*b* shows average values of pan emissivity and FIG. 9*c* shows average values of oil emissivity;

FIG. 16 is a table summarizing energy saving results;

FIGS. 23*a*-23*f* illustrate a GUI;

FIGS. 25*a*-25*d* show further energy readings/minute when cooking foodstuffs.

DETAILED DESCRIPTION OF THE INVENTION

Figure 1:
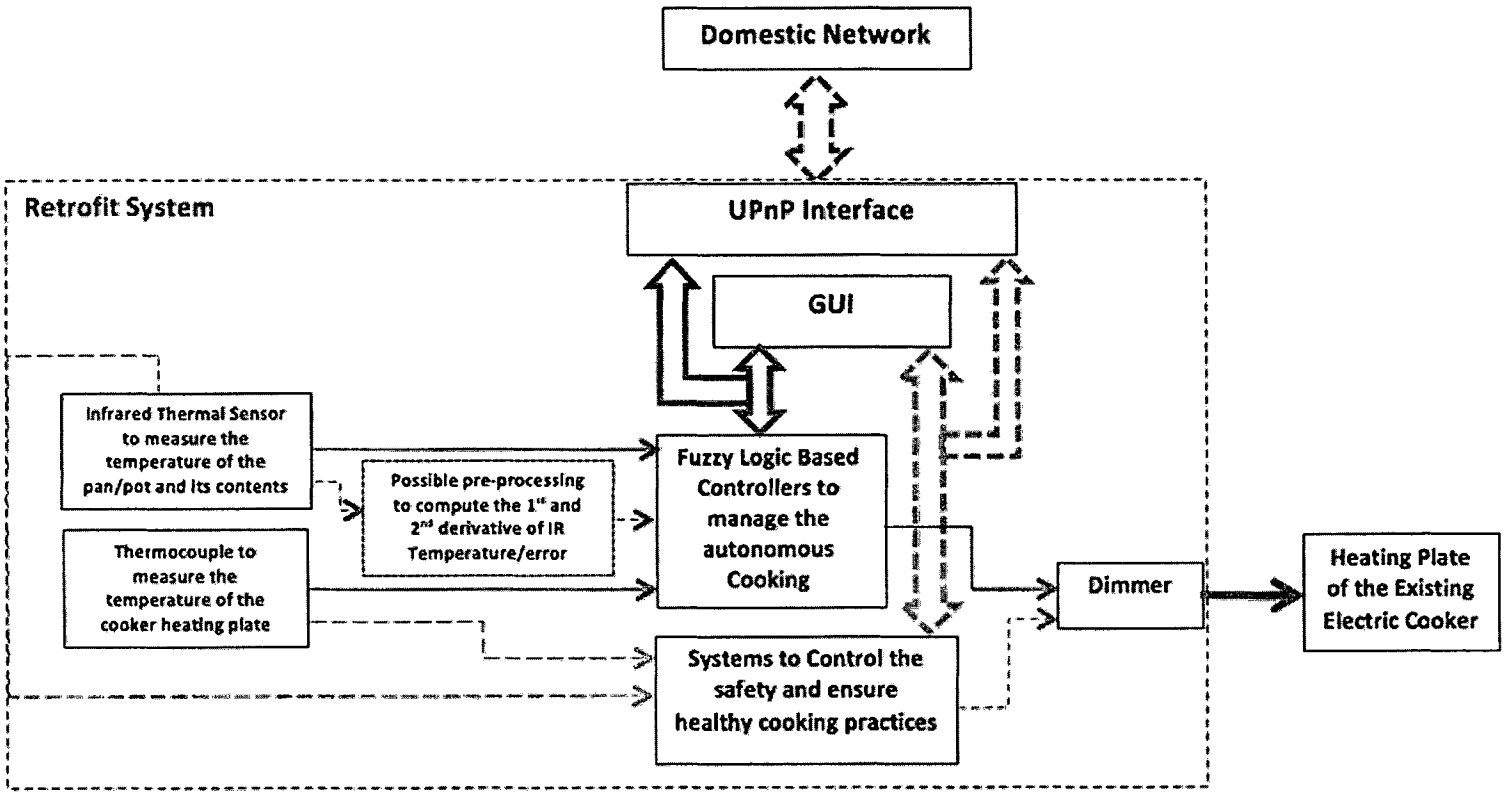
FIG. 1 is a high level overview of a system.
Figure 2A:
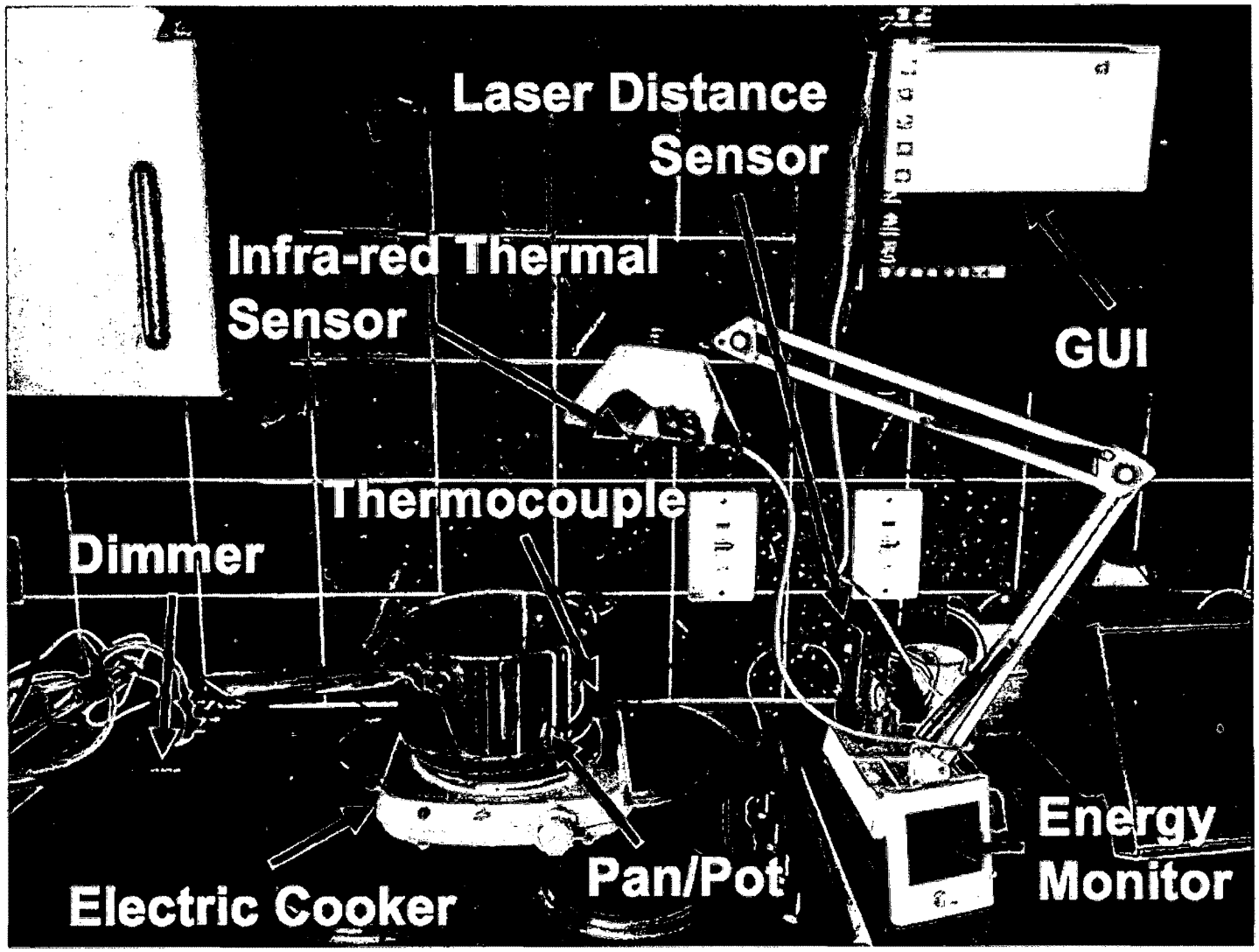
FIG. 2*a* illustrates a lay out for a system and FIG. 2*b* shows a graphic user interface.

FIG. 1 shows a high level overview of the proposed system which can be retrofit to an already in-use cooker, while FIG. 2*a* shows the system in real-world operation in a kitchen. The system presented has three physical inputs which are:

- an Infra-Red (IR) temperature sensor, used to infer the temperature of the pan/pot and its contents. As shown in FIG. 2*a*, the sensor is fixed at 30 cm above the pan as recommended by the manufacturer, although a distance of 25-35 cm has been found to be acceptable. The temperature measurements are used to calculate $1^{st}$ time derivative and the $2^{nd}$ time derivative and these values are stored as global variables that can be accessed by every module that needs them. The IR temperature sensors are non-contact sensors that infer the temperature of an object by measuring the amount of infra-red energy coming from the given object. However, the IR energy reaching the sensor is not only due to the actual energy emitted by the given object but could also be reflected IR radiation from other objects. In addition, the amount of IR rays emitted by a body is a function not just of its actual temperature but also another parameter called emissivity. Although emissivity depends on the temperature of the object, it is also dependent on the IR wave-length as well as a series of other factors such as the material that constitutes the body and the finishing of the given object surface, etc. Hence, it is almost impossible to know the value of the emissivity for an unknown object. Thus, the proposed system does not, in certain embodiments, rely only on the actual value of the temperature read by the IR sensor but primarily on the variations of temperature measured by the IR $1^{st}$ and $2^{nd}$ time derivatives of the measured temperature.
- A thermocouple that senses the temperature of the cooker heating plate. Were the thermocouple to be placed in the middle of the heating plate, the thickness of the thermocouple would create a gap between the cooker plate and the bottom of the pan which would reduce the heat transmission to the pan. To avoid this problem, the thermocouple is fixed (via a thermal binding material) at the lateral edge of the heating plate.
- A laser distance sensor used to verify the presence of the pan on the heating plate. This sensor is only used to enhance the safety of the system and it is not used in the control of semi-autonomous cooking.

The sensors' inputs are directly controlled by Arduino microcontrollers which act as a serial bridge to convey the sensors' data through the USB ports of the Personal Computer (PC). It will be appreciated that other controllers known in the art can also be used. The PC manages the input/output communications, the interfaces, the Graphical User Interface (GUI), the fuzzy logic controllers which manage the semi-autonomous cooking, and the systems managing the safety and the healthy cooking practices. The system Software (only 0.5 Mbyte) preferably utilises Java to facilitate its integration with the GUI and the Universal Plug-and-Play interfaces (UPnP) (both written in Java).

The system has just one physical output which is a dimmer (Eurolite EDX-1) used to control the electric current that flows to the cooker heating plate (through controlling the duty cycle used to control the cooker power supply). The control value is sent from the PC (via the USB port) running the fuzzy controllers to an Arduino microcontroller programmed to act as a serial-to-DMX bridge. The DMX protocol is suitable for the current invention as the system transmits the energy dimming value, pauses for a few milliseconds and retransmits again. This loop is continuous and each iteration takes about 25 ms. If one packet is missed or corrupted therefore, the device will correct its output to the right value within an extremely short timeframe. Given that the electric cooker takes time to transform the electric current changes into temperature changes, there should be no problems using this cost-effective efficient control communication protocol.

Hence, the system needs only three inexpensive sensors and a dimmer which plug to any PC USB ports in a plug and play fashion. The system software can be installed by a user similar to installing any self-extracting software package. Hence, the proposed system could be easily installed safely by a lay user. The system requires only a laptop (or the like), having, for example, with 2 GHz processor, 4 GB RAM and 500 GB hard disc along with sensors and dimmer. Hence, the system is much less expensive than a typical smart cooker and moreover also avoids the limitations of induction cookers, offering more semi-autonomous cooking options with the associated energy reductions and safety features not present in the existing cookers.

Figure 2B:
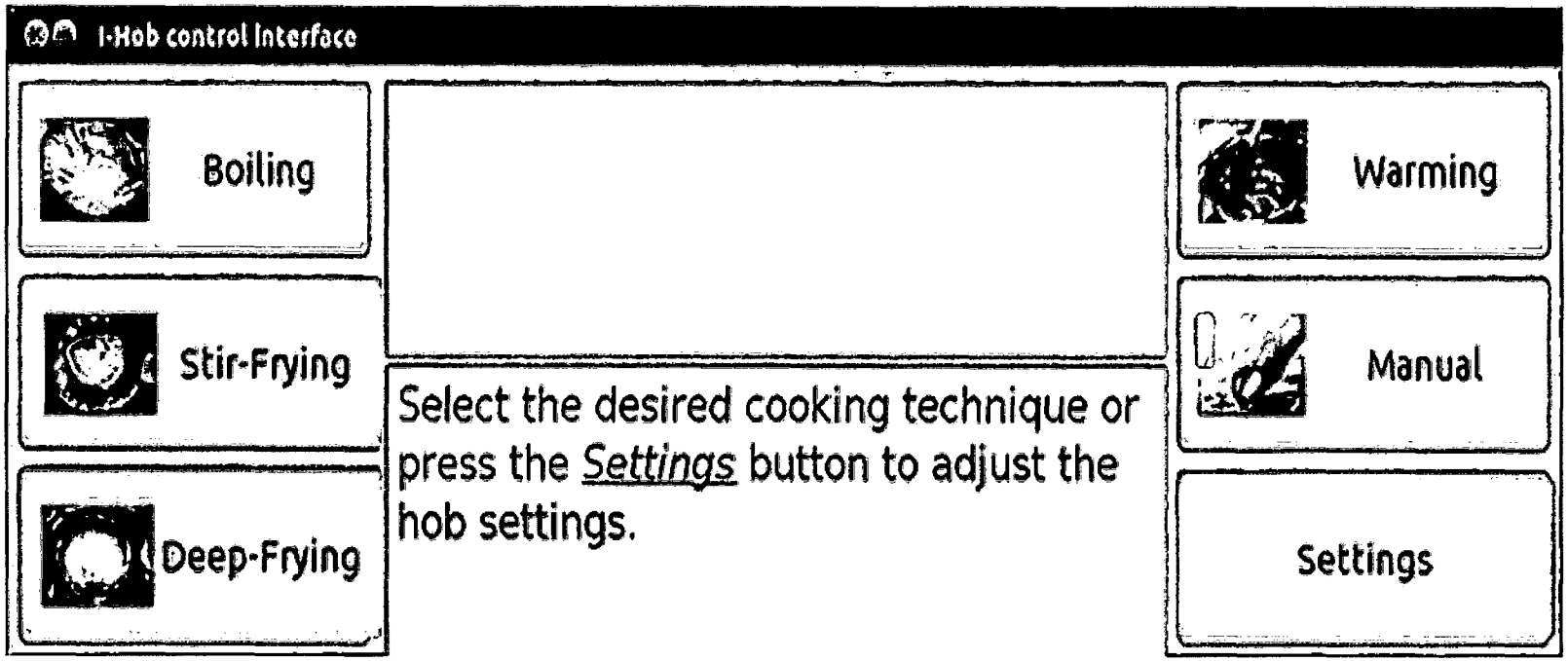

The interaction between a user and the appliance is possible through a GUI as shown in FIG. 2*b* which allows users to select the desired cooking technique, to set the cooking time, to specify the type of oil/fat used when deep-frying and to specify the pan type used when stir/shallow-frying. Through the GUI, it is possible to choose between four different semi-autonomous cooking techniques (as shown in FIG. 2*b*) which are: boiling, stir/shallow-frying, deep-frying and warming/melting. The user can also decide to control the appliance by manually pressing the dedicated button. The GUI can also be used to provide the user with visual feedback (as well as with audio messages) about the cooking progress and alerts on dangerous situations.

As shown in FIG. 1, the system has a network interface based on the UPnP protocol which is employed to publish information about the internal status of the appliance over a network. This interface is useful to complete a remote diagnostic test of the system, to synchronize the working status of other appliances with the cooker (like the extraction hood) and to enable an intelligent home speech system to provide the user with information about the cooking process while the user is away from the kitchen. The system has an energy monitor (shown in FIG. 2*a*) to allow the user to track the consumed energy.

The GUI and the UPnP interfaces provide information about: the user-selected cooking technique, whether boiling has been reached, whether the desired frying temperature has been reached, the remaining cooking time, when the user should insert food, whether cooking is finished and any system errors or warnings. The system also warns the user when the system is stopped and if the cooker plate is still hot (above 40° C.) and if any oil has fallen below the optimal frying temperature because the user has added too much food. The system also warns the user if a temperature is selected that is above the oil smoking temperature. The system also alerts the user on detection of dangerous situations such as a pot/pan boiling-dry or a pan has reached a temperature above 250° C. as for instance, non-stick pots/pans heated beyond 250° C. could cause toxic chemical changes in the non-stick surface which can cause serious health risks to the users.

Below are described the fuzzy logic based systems used to realise safe and energy efficient semi-autonomous control for boiling, frying and warming/melting respectively.

Boiling food is probably the most common cooking technique where food is cooked in a volume of water that has reached a steady boiling state and where the temperature is approximately constant. Thus, boiling guarantees to cook food evenly.

Figure 3:
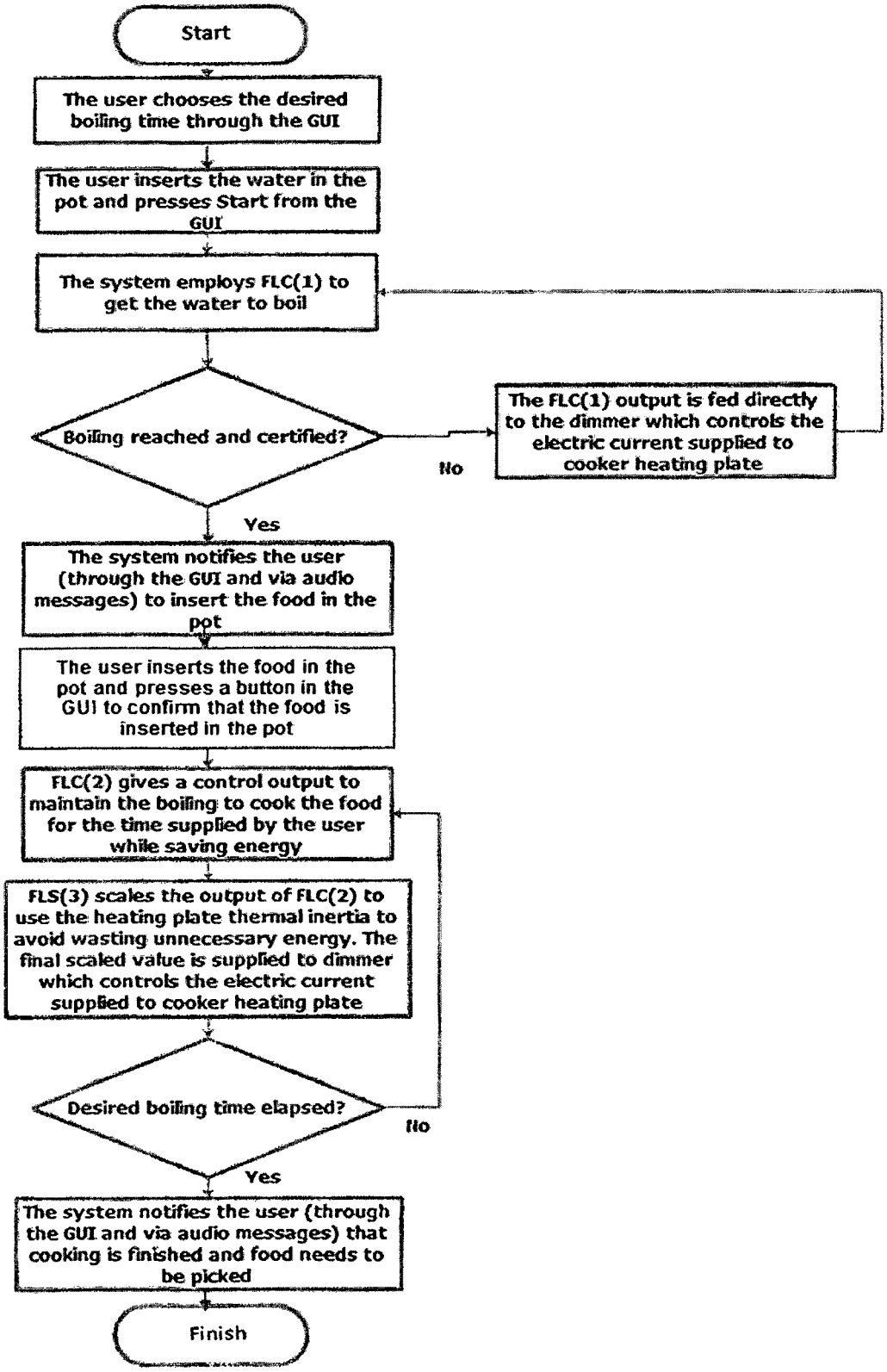
FIG. 3 is a flow chart showing a high level overview of a system controlling a food boiling process.

FIG. 3 presents a flowchart showing a high level overview of how an embodiment of the system controls the heating semi-autonomously to bring water to boil. When boiling is detected and certified, the system notifies the user through the GUI (and via audio messages) to insert the food in the pot. The user presses a button in the GUI to confirm that food has been added to the pot. The system then regulates the heating to maintain the boiling state as long as requested by the user-supplied boiling time while trying to minimize the energy consumption. The user is alerted to pick up the food at the end of the cycle. The system is capable of detecting if a pot boils dry and to switch off the appliance automatically. The system also reduces the possibility of over-boiling as only the needed energy is provided to sustain boiling.

Figure 4:
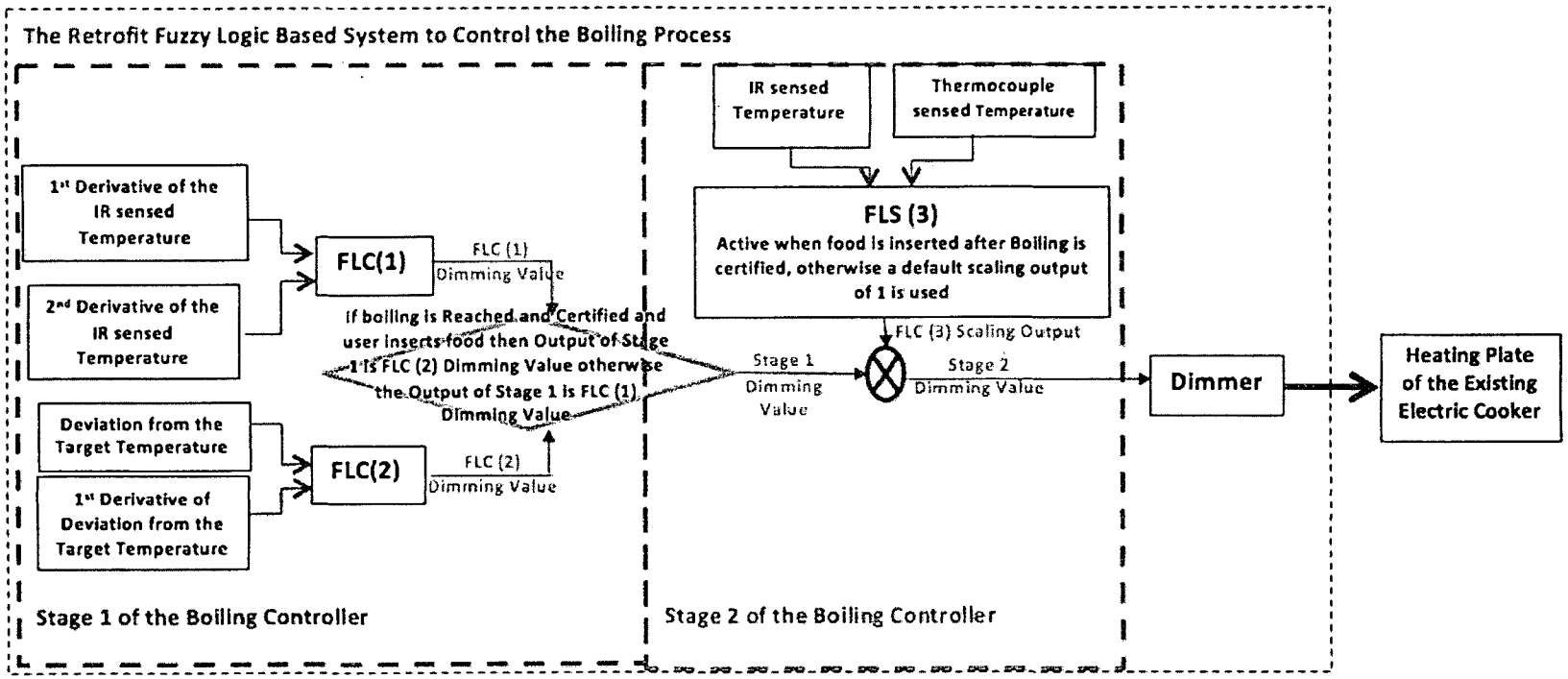
FIG. 4 is an overview of a fuzzy logic based system employed to control a boiling process.

As shown in FIG. 4, the Fuzzy Logic System (FLS) that controls the boiling function is based on a series of Fuzzy Logic Controllers (FLCs) distributed in two stages. The first stage, stage 1 utilises two FLCs where FLC(1) aims to bring water to boil and FLC(2) is enabled when boiling is reached and certified, and food added to the pot. FLC (2) then maintains the water at boiling point to cook the food for the desired time set by the user, whilst saving energy. The Stage 1 output is supplied to the second stage, Stage 2 that utilises FLS(3) and exploits the thermal inertia of the heating plate and scaling the output of Stage 1 to avoid wasting energy.

The output of Stage 2 is then sent to the dimmer which controls current flowing in the heating plate of the existing cooker. Should boiling not have been reached, the output of Stage 1 is an output of FLC(1) output in which the FLS(3) is disabled and a default scaling value of 1 scales the output of FLC (1). Hence the dimmer is fed with the output of FLC(1) till boiling has been reached and certified. The FLCs and FLSs utilised are based on the Mamdani FLC (FLS) which employs the Max-Min inference and the centre of sets defuzzification.

In more detail, the first stage (Stage 1) starts with the application of FLC(1) which aims to bring water to boil and FLC(1) remains active till boiling is reached and certified. FLC(2) is enabled when boiling is certified and food added to the pot so that FLC (2) maintains the water at boiling point to cook food for the desired time set by the user while saving energy. If the user interaction causes significant temperature variations from the boiling point (i.e. dropping by more than 15° C.) then FLC(2) is disabled and FLC(1) is re-enabled.

As explained above, it is not possible to use directly the temperature value sensed by the IR sensor since the system is composed of a pot, plus water, plus food plus optional lid which causes the sensor to need to deal with an unknown and changing emissivity. However, the information from IR-measured temperature variations are utilised as a source of information, as during the first period of cooking, when the water has not yet boiled, providing heat to the pot causes the temperature of the system to rise (and a positive $1^{st}$ time derivative). As the boiling point is approached, the temperature stabilises (giving a nearly zero $1^{st}$ time derivative) as long as the heat provided is sufficient to maintain the boiling state. Hence, FLC(1) receives its inputs from the $1^{st}$ and $2^{nd}$ IR temperature time-derivatives to control the heating applied to bring the water to boil.

Figure 5A:
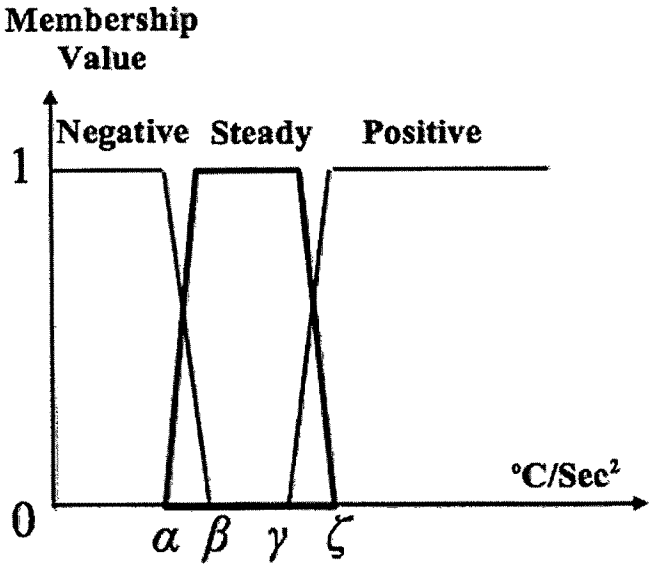
FIGS. 5*a* to 5*c* are fuzzy sets representing respectively the first derivative, second derivative of the IR sensitive temperature, and the output dimming value for two fuzzy logic controllers.
Figure 5B:
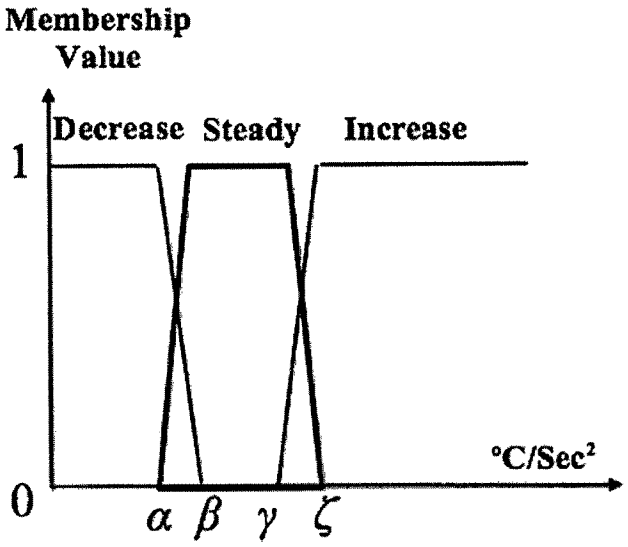

FIG. 5*a* and FIG. 5*b* show the fuzzy sets associated with FLC(1) inputs $1^{st}$ and $2^{nd}$ IR temperature time-derivatives respectively where the support of these fuzzy sets is identified by the parameters $\alpha$, $\beta$, $\gamma$, $\zeta$. The default values associated with these parameters are determined empirically and typical values are: $\alpha=-500$, $\beta=-200$, $\gamma=350$, $\zeta=700$ and $\alpha=-900$, $\beta=-500$, $\gamma=500$, $\zeta=900$ for the $1^{st}$ and $2^{nd}$ time-derivatives respectively. The values of $\alpha$,$\beta$, $\gamma$, $\zeta$ change adaptively according to the water volume as, for example, small amounts of water take less time to boil resulting, at least in the $1^{st}$ temperature time-derivatives being greater than when using larger amounts of water. Hence, the employed strategy is to tune the parameters $\alpha$,$\beta$, $\gamma$, $\zeta$ proportionally to the average IR temperature $1^{st}$ time-derivative calculated over the first 30 seconds of the cooking process which translate into a lookup table (generated empirically) to tune the default values to produce the suitable $\alpha$, $\beta$, $\gamma$, $\zeta$ for the fuzzy sets of the $1^{st}$ and 2nd IR temperature time-derivatives respectively.

Figure 5C:
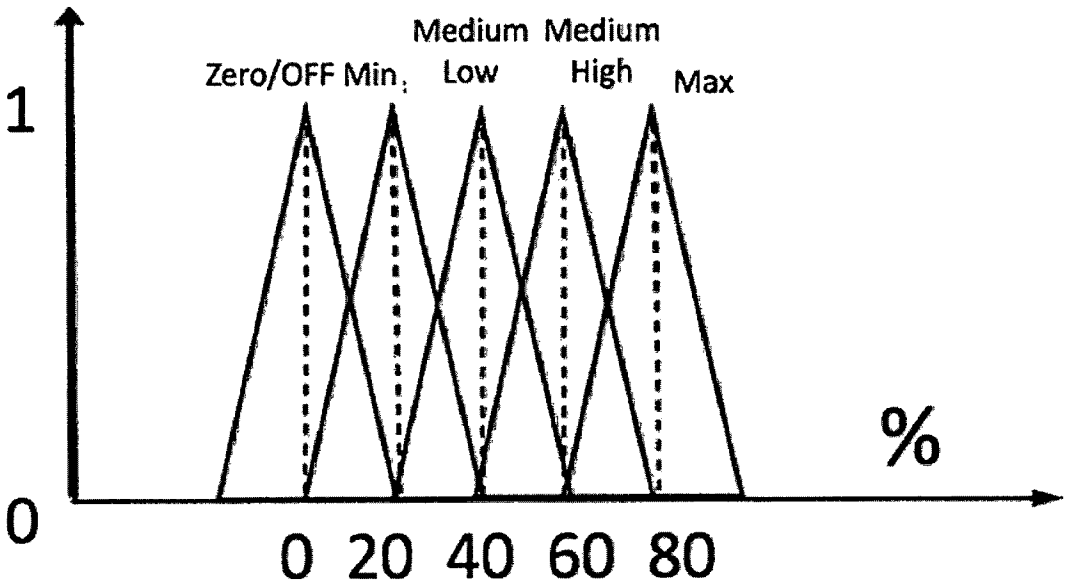

FIG. 5*c* shows the fuzzy sets associated with the dimming output of both FLC(1) and FLC(2). FIG. 6*a* shows the rule base of FLC(1) (obtained empirically) where FLC(1) aims to bring water to the boiling point whilst using as little energy as possible. Up until boiling is reached and certified (see below) and food is added to the pot, the output of FLC(1) is fed to the dimmer (as FLS (3) is disabled and the value of FLC(1) is scaled with a default scaling factor of 1).

Figure 7A:
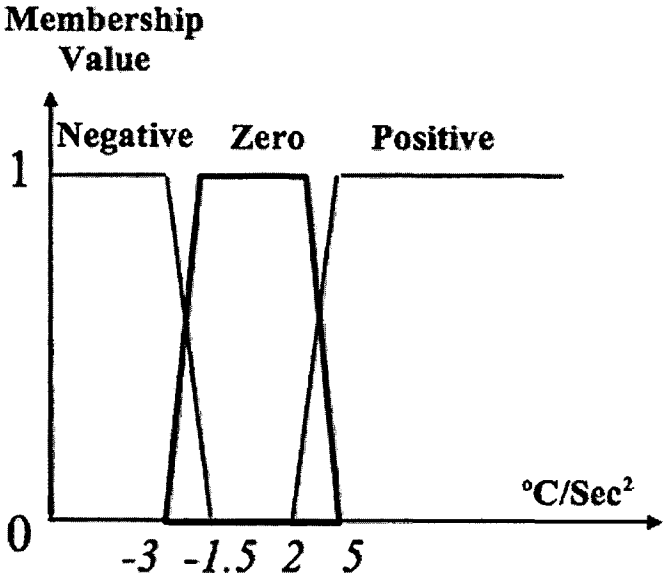
FIG. 7*a* is a fuzzy set representing the water temperature error for FLC(2) in the volume process.
Figure 7B:
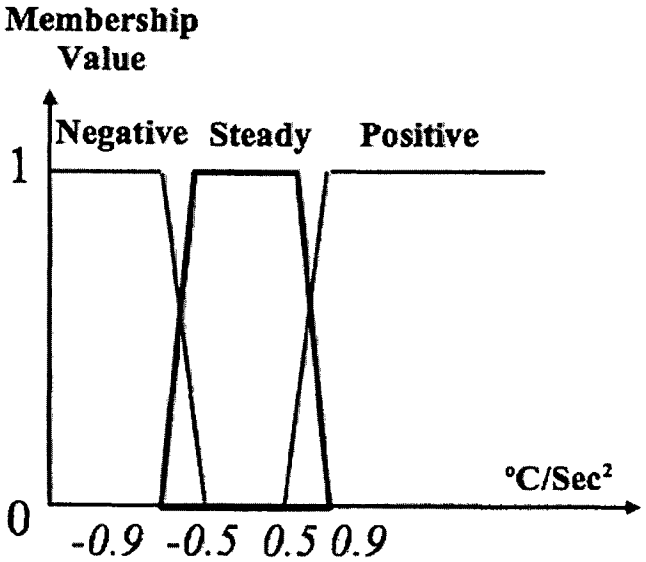
FIG. 7*b* is a fuzzy set representing the water temperature error $1^{st}$ order derivative for a FLC(2)

When the system detects that the temperature time-derivative is steady (nearly zero) for a certain time (10 seconds), the system starts a procedure to certify that boiling has occurred. In this procedure the heating is kept to its maximum value for 30 seconds. If the IR temperature reading does not increase any more, the system certifies that boiling has been reached. The user is then notified and asked to place the food in the pot and the existing IR temperature is recorded as the target temperature to be maintained. The activation of FLC(2) takes place once water boiling is certified and food inserted in the pot. The latter is confirmed by the user pressing the relevant button in the GUI. The FLC(2) allows the water temperature to be maintained close to the boiling temperature without wasting unnecessary energy. FLC(2) computes the temperature deviation between the current IR temperature and the target temperature (the temperature sensed by the IR sensor when boiling was certified). The inputs to FLC(2) are the temperature deviation from the target and the $1^{st}$ time-derivative of this deviation. The rule base used by FLC(2) is shown in FIG. 6*b* (tuned empirically) and FIGS. 7*a* and 7*b* show the fuzzy sets (tuned empirically) associated with the inputs to FLC(2).

If the user interacts with the system, causing the measured IR temperature to deviate by more than 15° C. from the target for more than 4 seconds, FLC(1) is then reactivated until the boiling is certified again. The design for Stage 1 of the presently disclosed boiling system allows the limitations of commercial cookers like the Whirlpool 6th Sense™ to be overcome as the system does not make any assumptions about the system emissivity through the use of the time-derivatives of the IR sensed temperature. It should be noted that FLC(2) can drive the output of the cooker more effectively than FLC(1) due to the presence of a temperature target to be maintained (the target is not the same for every cooking scenario as this target depends on the system emissivity).

The output of Stage 1 is then processed by FLS (3) which aims to reduce the energy consumption through exploiting the thermal inertia of the heating plate.

In line with standard heat-transfer theory, the higher the temperature difference between the heating plate and pot, the faster is the water heating inside the pot. However, referring to FIG. 7*c*, it can be seen that the heat diffuses in every direction from the heating plate and that the heat absorbed by the bottom of the pot is just a fraction of the total heat developed by the plate. Thus, the higher the plate temperature, the higher the amount of heat wasted either through the act or the surface on which the plate is located. In addition, as the pot itself dissipates heat, this prolongs the cooking time due to the greater amount of heat dispersed by the pot. Hence, in order to provide energy reduction whilst having optimal cooking results, there is a need to find a suitable temperature difference between the heating plate and the pot. The function that describes the energy consumption is typically a nonlinear equation that depends on the cooker heating plate temperature, the pot temperature, the pot model, the amount of water to boil, the water properties and many other factors. It is probably impossible to build a mathematical model that produces satisfactory results under all possible conditions and uncertainties. However, it was surprisingly found experimentally, with different types of pots, with or without using a lid and using different quantities of water, it was found that maintaining a temperature difference of 100-120° C. between the cooker plate and the water temperature (which is relative to the IR sensor reading) allows satisfactory cooking results to be achieved while consuming, on average, less energy.

Figure 7C:
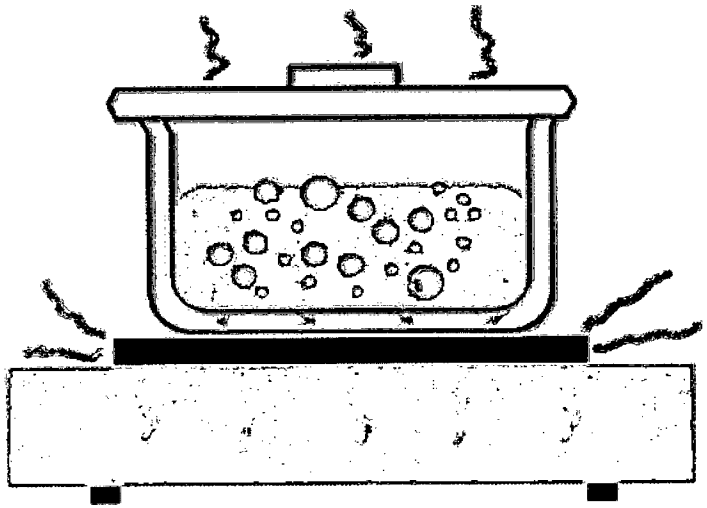
FIG. 7*c* shows heating diffusion on a cooking plate and FIG. 7*d* shows a fuzzy set representing the input 2 FLS(3)
Figure 7D:
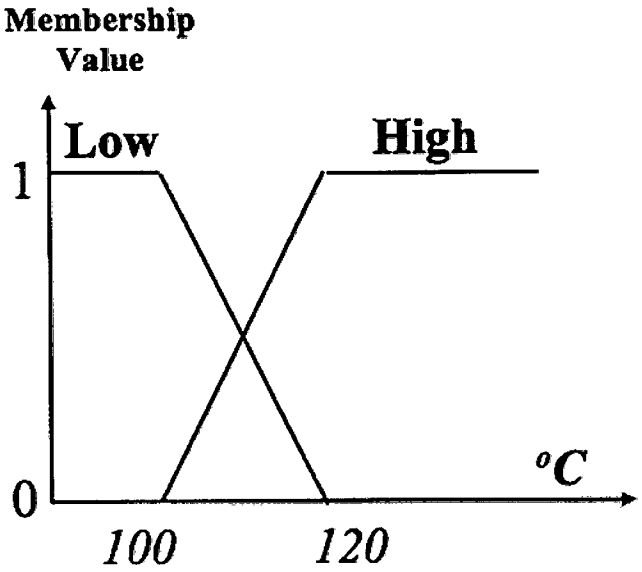
Figure 8A:
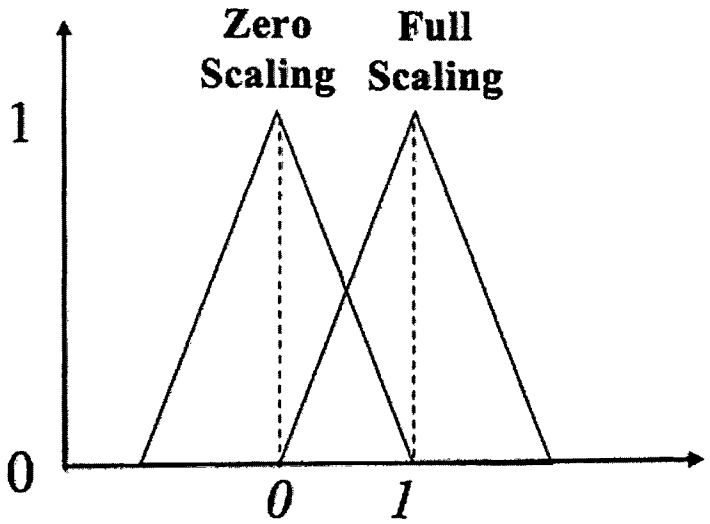
FIG. 8*a* is a fuzzy set associated with the output of FLS(3) and FIG. 8*b* is a fuzzy set used to fuzzify the difference of the temperatures between the thermocouple and the infrared sensors.

FLS(3) is implemented to scale the output value supplied by Stage 1 to maintain a temperature difference between the heating plate and the water to be in the range 100-120° C. FLS(3) has just one input which is the difference in temperature between the thermocouple (TC) (measuring the heating plate temperature) and that determined by the IR temperature sensor (relative to the water temperature). This controller has one output which scales the output of Stage 1 dimming value by a value between 0 and 1. FIG. 7*c* shows the fuzzy sets used by the input to FLS(3) and FIG. 8*a* shows the fuzzy sets used for the output of FLS(3). FIG. 6*c* shows the rulebase of FLS(3). The crisp output of FLS(3) is termed $output_{FLS(3)}$ which will equal 1 (i.e. no scaling of the Stage 1 dimming value) if the temperature difference between TC and IR is below 100° C. as in this case, if the power is reduced the boiling state might be lost. If the temperature difference between TC and IR is above 120° C., the value of $output_{FLS(3)}$ will be equal zero (i.e switching off the heating). This means that the heating can be switched off as there is enough thermal inertia in the heating plate to maintain the boiling state of the water. If the temperature difference is between 100-120° C., the crisp output of Stage 1 dimming value will be scaled by $output_{FLS(3)}$.

Figure 8B:
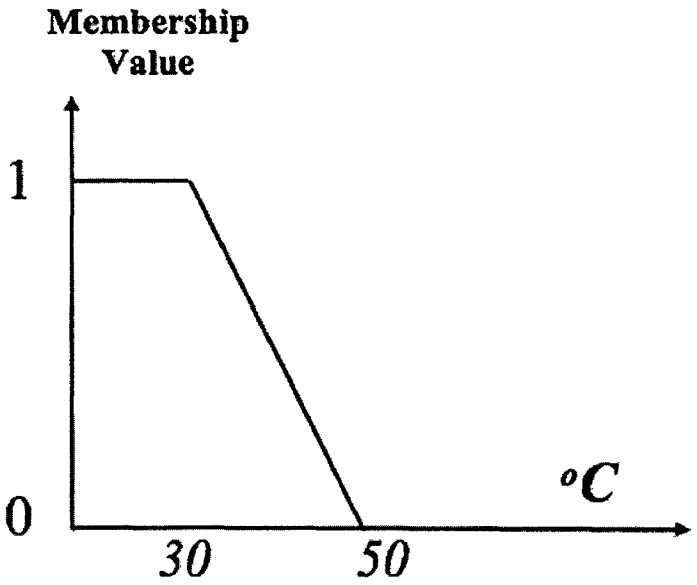

If the user places a lid over the pot when the water is boiling, the IR sensor will read the lid temperature. This is not a problem because the lid temperature follows the same dynamic as the temperature of the water inside the pan, although it does this with a delay of about 60-90 seconds. This means that when the water temperature decreases to unacceptable values, the system detects this when it is too late. Again it has been surprisingly found experimentally that if a difference of 30° C. between the temperature of the cooker heating plate, the cooker heating plate being at the higher temperature, and the temperature sensed by the IR sensor is maintained (whatever this represents, the lid temperature or the water temperature) this is sufficient to guarantee maintenance in the boiling state. To achieve this behavior, another component is added to Stage 2 which increases the heat provided by cooker plate whenever the temperature difference between the TC and the IR sensors falls below 30° C. The new component has just one input which is the temperature difference between the TC and the IR sensors (termed var). This input is then fuzzified by the fuzzy set shown in FIG. 8*b* to result in the membership value $\mu_{var}$. Hence, the final output of Stage 2 (Stage2 Dimming Value) is written as follows:

$$\text{Stage2 Dimming Value} = \text{Max_Power} * \mu_{var} + (output_{FLS(3)} * output_{Stage1}) * (1 - \mu_{var}) \quad (1)$$

where $output_{Stage1}$ is the crisp dimming value of Stage 1. Hence, the Stage2 Dimming Value is going to be equal to $output_{FLS(3)} * output_{Stage1}$ if the temperature difference between TC and IR is greater than 50° C. and so boiling can be sustained and energy can be saved. In the event the temperature difference between TC and IR is less than 30° C., the Stage2 Dimming Value will be turned to maximum power to sustain the boiling process. The Stage2 Dimming Value will be computed according to Equation (1) for temperature differences falling between 30° C. and 50° C.

Figure 9A:
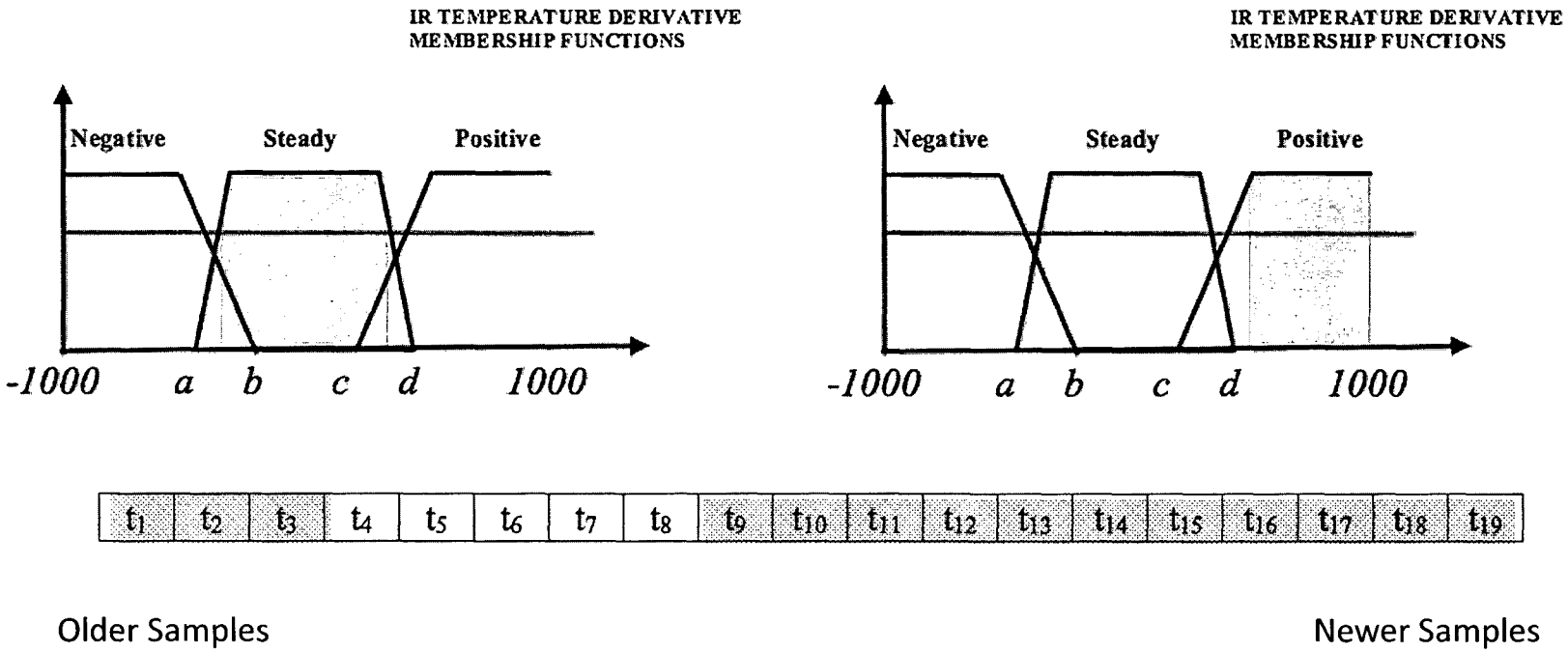
FIG. 9*a* shows a circular buffer to identify the boiling-dry event.

It is believed that only Terai et al. have reported a system to detect if a pot boils dry. Even then, that system has a major flaw in that detection of that state occurs up to 2 minutes after the event. The boiling-dry system implemented in the present invention relies on two safety checks. The first check is based on checking if the temperature sensed by the IR sensor passes 105° C. (above the boiling temperature of 100° C. for water). Because the system emissivity (with or without a lid) has values usually between 0.45 and 0.98 then where an IR sensed value of 105° C. is measured, this can correspond to a real temperature between 107 and 233° C., which needs the boiling-dry event to be fired. To improve the reliability of the boiling-dry detection, a second check works in parallel with the first check where every second the $1^{st}$ time-derivative of the IR temperature is computed and the values are stored in a 20-sample circular buffer (as shown in FIG. 9*a*) to identify any temperature surges. Hence, the boiling-dry event is triggered if the system has certified that water boiled AND the three oldest samples in the buffer have values corresponding to a STEADY derivative with a membership value above 0.6 AND the twelve newest samples correspond to a positive $1^{st}$ time-derivative with a membership value of above 0.6. This second check guarantees to detect a pan boiling-dry within 20 seconds from the moment this event starts.

When controlling a frying process then a second embodiment of the above-described invention for boiling is used. During frying, food loses water and partially takes up fat which improves palatability. However, when incorrectly performed, the procedure leads to an unsatisfactory taste and unhealthy food. Also, the temperature of the pan must be kept under control to avoid bringing the oil above its smoking point which can produce toxic chemicals and can cause very dangerous situations as oils are flammable liquids. Deep-frying requires good cooking skills where one has to choose the appropriate oil/fat and bring it to the correct temperature, the user also needs to add an amount of food that does not decrease the oil temperature too much and also to remove food from the pan at the right time. Stir/ shallow-frying requires less oil/fat to be used and it requires the food to be stirred frequently.

During deep-frying (when the pan is full of oil/fat), the emissivity of the system does not depend to a great extent on the type of pan but depends mainly on the type of oil/fat. On the other hand, when stir/shallow-frying (which entails using small amounts of oil/fat), the emissivity depends mainly on the type and colour of the pan. Tests were carried out to determine the average emissivity of various pans (divided in three groups: black non-stick pans, ceramic pans (usually white in color) and metal steel/aluminum pans) and the results are shown in FIG. 9*b*. FIG. 9*c* shows the average emissivity of various oil/fats of different commercial brands.

Figure 10:
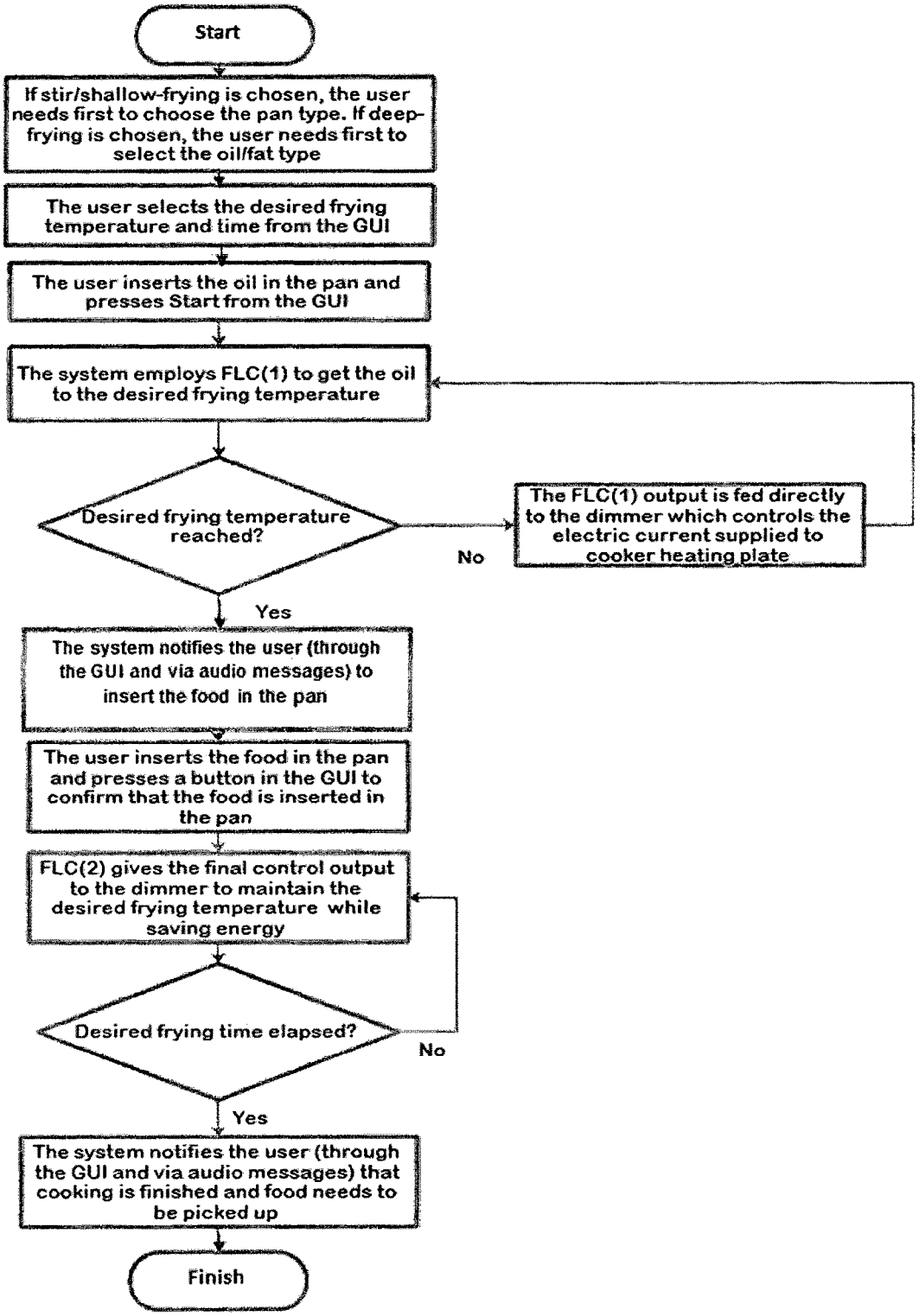
FIG. 10 is a flow chart showing a high level overview of a semi-autonomous system in accordance with the second embodiment of the invention.

FIG. 10 is a flowchart showing a high level overview of how the proposed system controls semi-autonomously and safely, the heating during the whole frying process with the goal of maintaining the desired frying temperature (selected by the user) to produce very good cooking results without allowing the temperature to be above the smoking point of the oil/fat.

The proposed frying control system uses the emissivity values of FIG. 9*b*, 9*c* (depending on whether deep or stir frying is chosen) to correct the IR temperature sensor readings. Unfortunately, when the user puts food into the pan the emissivity of the system changes in an unpredictable way and it is no longer possible to rely on the IR temperature sensor readings to maintain the desired frying temperature. To address this, when the oil has reached the required frying temperature (before the food is inserted), the implemented system records the temperature of the cooker heating plate sensed through the thermocouple (termed Target temperature) as this is the temperature that has carried the oil to the desired temperature. Hence, maintaining the TC as close as possible to the target temperature will maintain the temperature at the bottom of the pan and will allow the oil/fat temperature to be maintained close to the desired frying temperature. In order to reduce the probability of kitchen accidents, the system impedes the cooker heating plate temperature to go above 250° C. (i.e. below an oil's flash and fire points).

Figure 11:
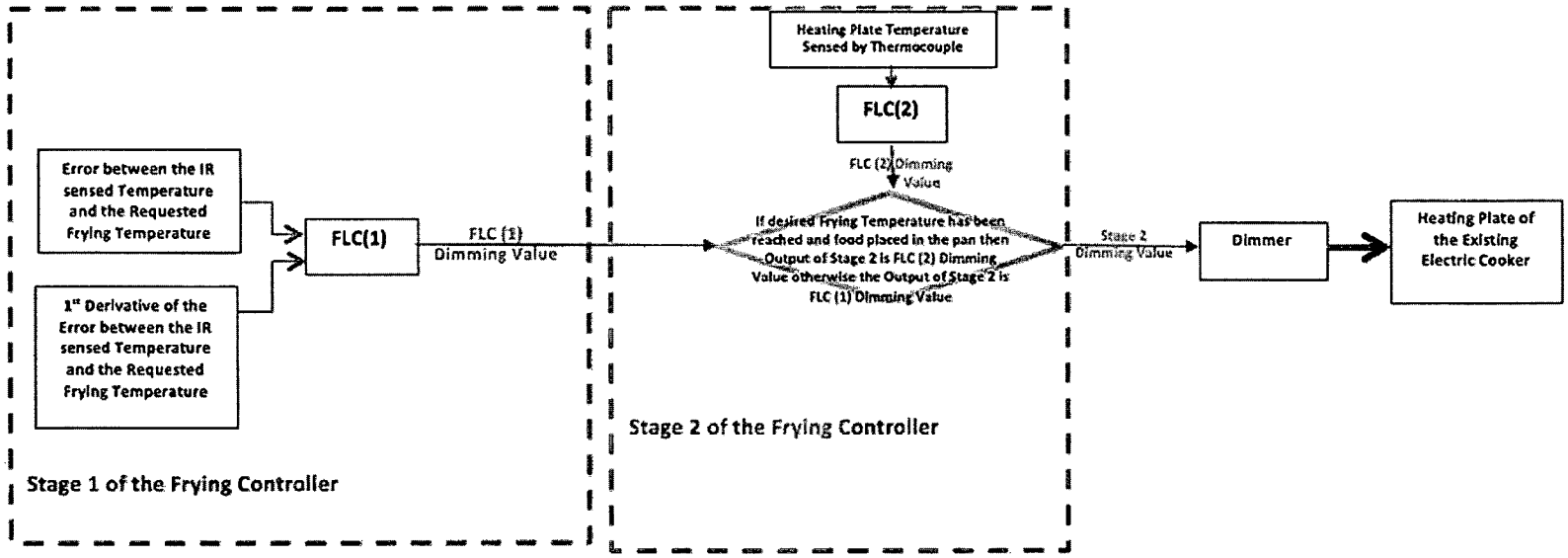
FIG. 11 is an overview of a fuzzy system employed to control a frying process.

FIG. 11 shows the architecture of the frying system controller which has two stages, where FLC(1) is active in Stage 1 until the desired frying temperature is reached (at which point the system alerts the user to put the food in the pan). When the user inserts the food in the pan (as confirmed by pressing the relevant button in the GUI), FLC (2), Stage 2 is activated until the food is ready for collection by the user. FLC (1) provides the dimming output of stage 2 to the dimmer till the desired frying temperature is reached and the user inserts the food in the pan following which the FLC (2) provides the dimming output to the dimmer.

It should be noted that the controllers differ between frying and boiling. When frying, then for the inputs for FLC(1), the data from the IR sensors can be used directly as emissivity depends on the oil used (when deep-frying) and pan type (when stir-frying) which can be measured ahead of time. Hence a reasonable estimate can be made of the actual temperature being measured. When boiling however, then for FLC (1), IR values cannot be used directly as the emissivity of the system is difficult to estimate for all the possible combinations of water volumes, pot types presence of a lid etc. However, after boiling, adding food does not change the system emissivity greatly due to the large water volume and hence FLC (2) can use the deviation from the IR target temperature. However, during frying, after food is inserted, the food begins absorbing fat and losing water which changes the system emissivity in an unpredictable way thus when frying, FLC (2) uses the TC sensor as the IR sensor can no longer be relied upon.

Figure 12A:
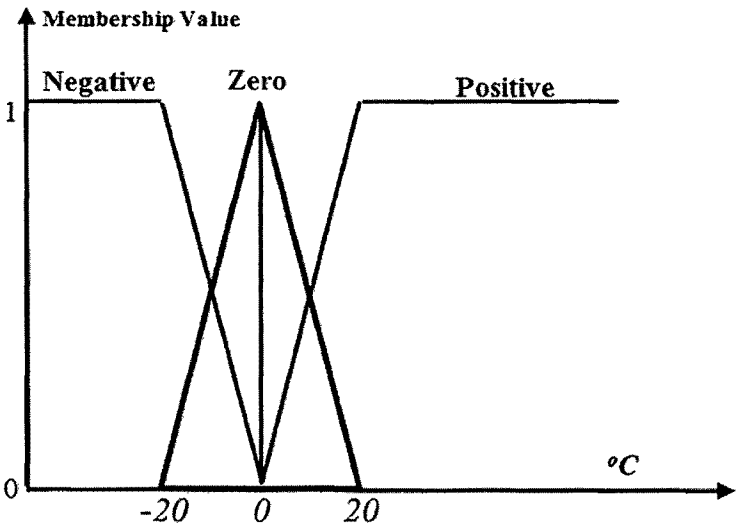
FIGS. 12*a* and 12*b* are fuzzy sets representing the temperature error input for FLC(1) when frying and the first derivative of temperature error input for FLC(1) during frying respectively, FIGS. 12*c* and *e* are rulebases for the FLC(1) and FLC(2) for the frying embodiment
Figure 12B:
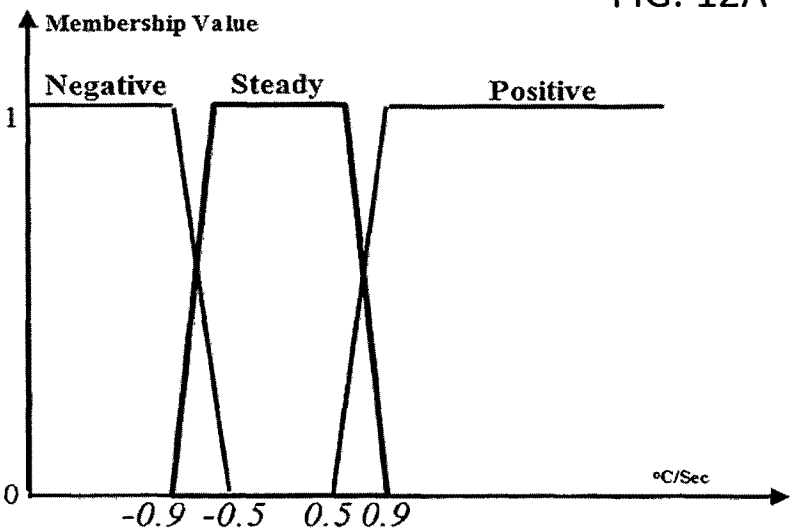

As shown in FIG. 11, the first stage of the frying system utilises FLC(1). FLC (1) inputs are the IR temperature error (i.e. the difference between the requested frying temperature and the current IR temperature corrected by the estimated emissivity) and its $1^{st}$ time-derivative. The fuzzy sets representing the inputs of FLC(1) are shown in FIGS. 12*a* and 12*b*. The output fuzzy sets for FLC (1) are shown in Figure Sc. The rule base of FLC (1) is shown in FIG. 12*c*. When the desired frying temperature has not been reached, FLC (1) provides the dimming output through stage 2 to the dimmer.

Figures 12D, 12E:
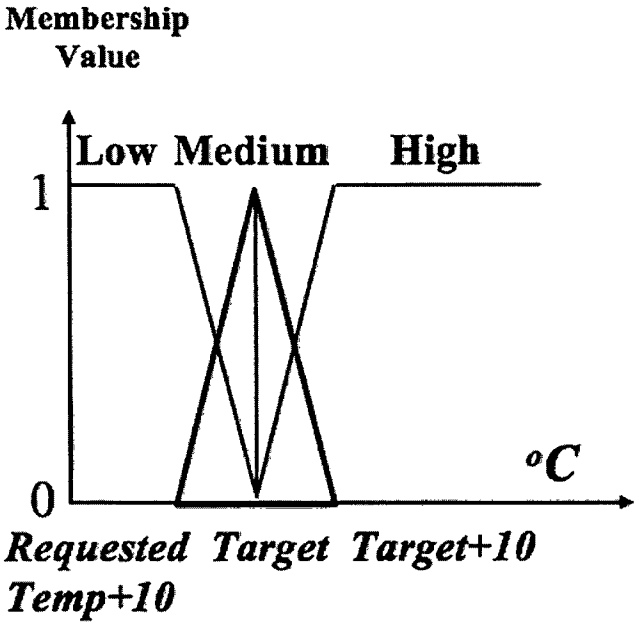
FIG. 12*d* is a fuzzy set for the input to FLC(2) in the frying embodiment.

Once the required frying temperature is reached, the system can issue an audio message to obtain the user's attention and to invite the user to place the food into the pan. At the same time, FLC(2) is enabled so that the system records the temperature of the cooker heating plate, sensed through the TC when frying is detected. This is called "Target" temperature as this is the temperature that has carried the oil to the desired temperature. FLC(2) has just one input which is the cooker heating plate temperature sensed by the TC whose fuzzy sets are shown in FIG. 12*d*. The output fuzzy sets for FLC(2) are shown in Figure Sc. The rule base of FLC (2) is shown in FIG. 12*e*. After the frying temperature has been reached and the user supplies the food to the pan, the output of stage 2 to the dimmer is supplied by the FLC(2) dimming output.

The warming function provides a constant heating level where the user can select between eight different heating levels and the dimming value is set and kept constant during the whole cooking process.

For each cooking style, 40 experiments were performed involving 40 people from different backgrounds and age groups. The experiments included cooking various foods with various pots, pans and oils/fats. The experiments were conducted in a real-world simulation test bed for intelligent environments. The proposed system was retrofitted to an existing commercial cooker and the software was installed on a PC where the GUI was accessed from a touch screen connected to the PC. The following present the evaluations performed to validate the system autonomy, energy savings and safety.

Figure 13A:
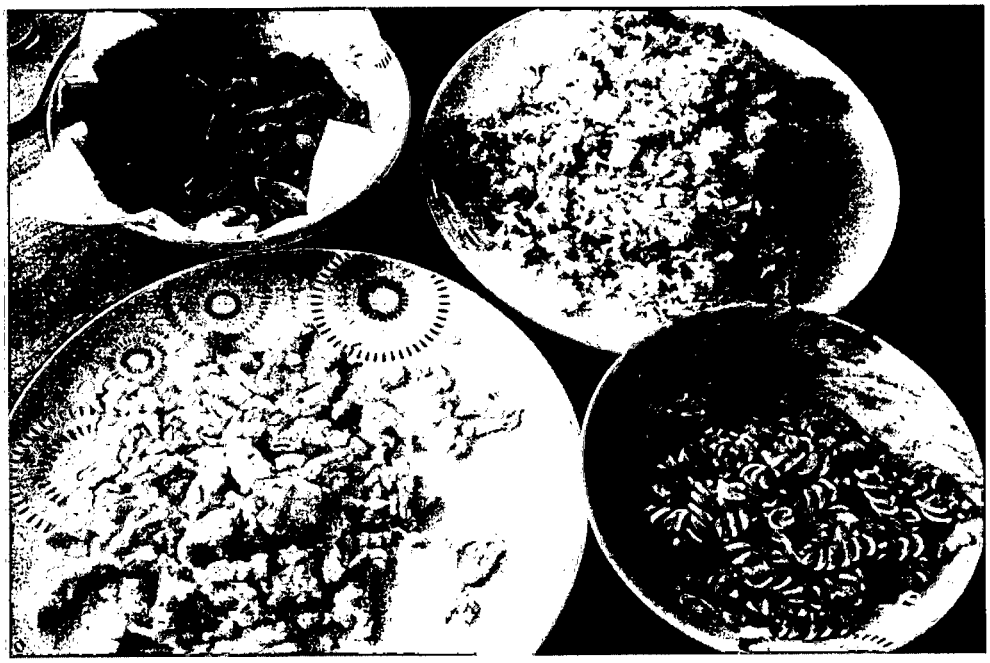
FIG. 13*a* shows samples of food cooked using the system.

In all the forty experiments performed for the various cooking techniques, the cooking was semi-autonomously driven by the proposed system. FIG. 13*a* shows samples of the food cooked by the system.

Figure 13B:
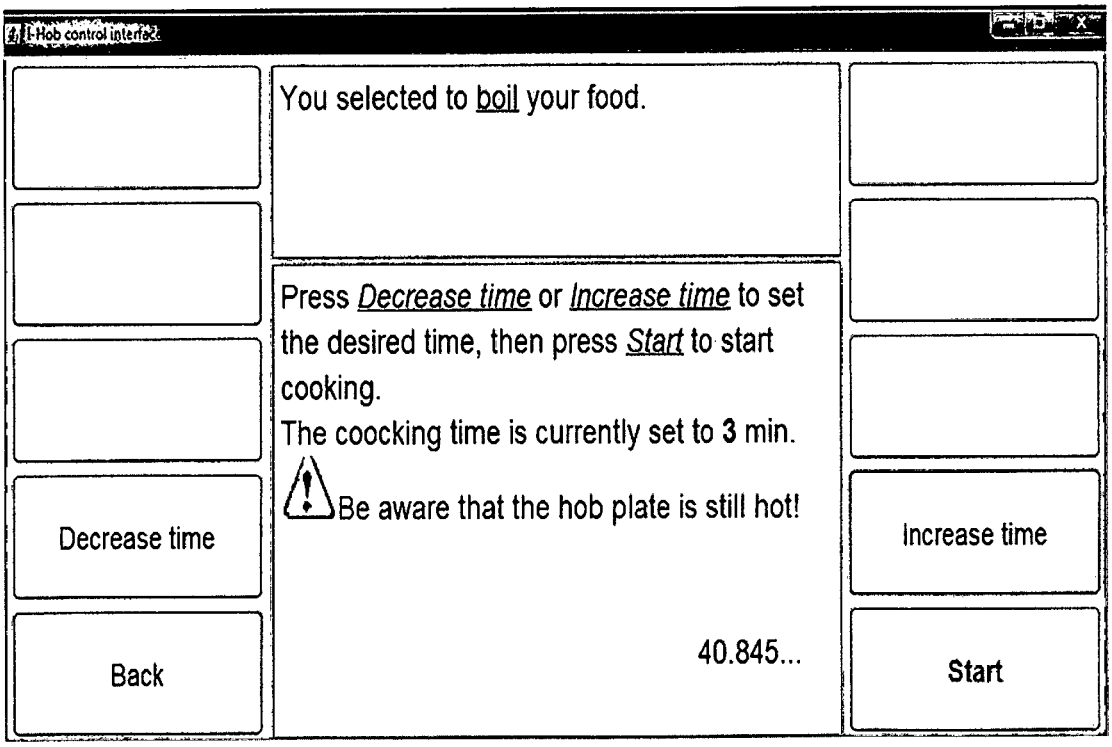
FIG. 13*b* shows a graphic user interface associated with FIG. 13*a*.
Figure 13C:
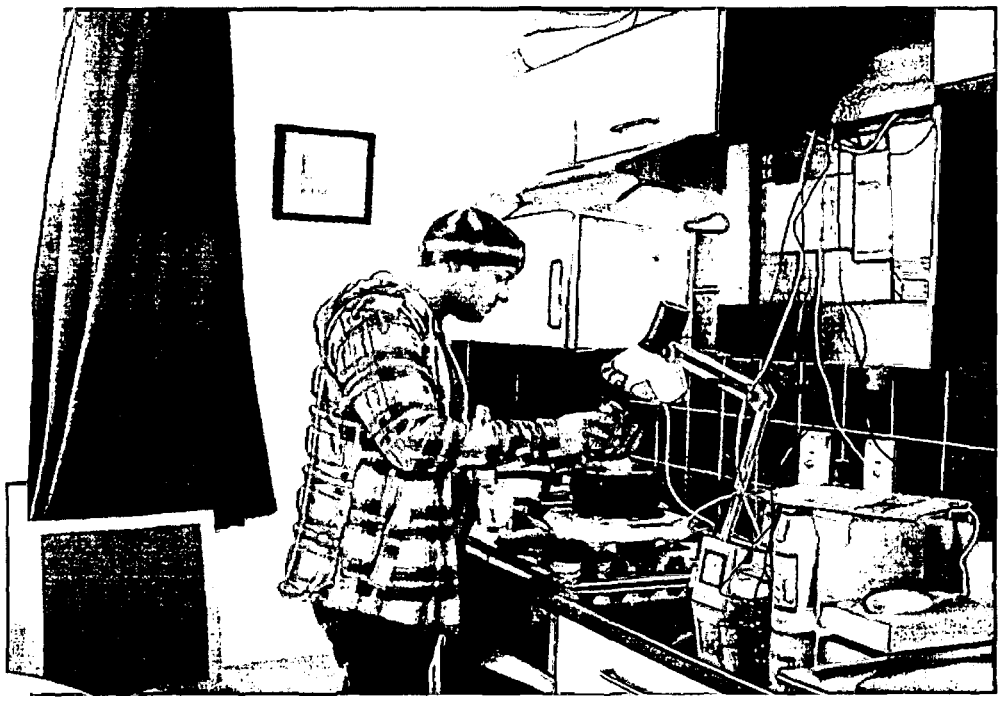
FIG. 13*c* shows a user placing food into a pot boiling.
Figure 14A:
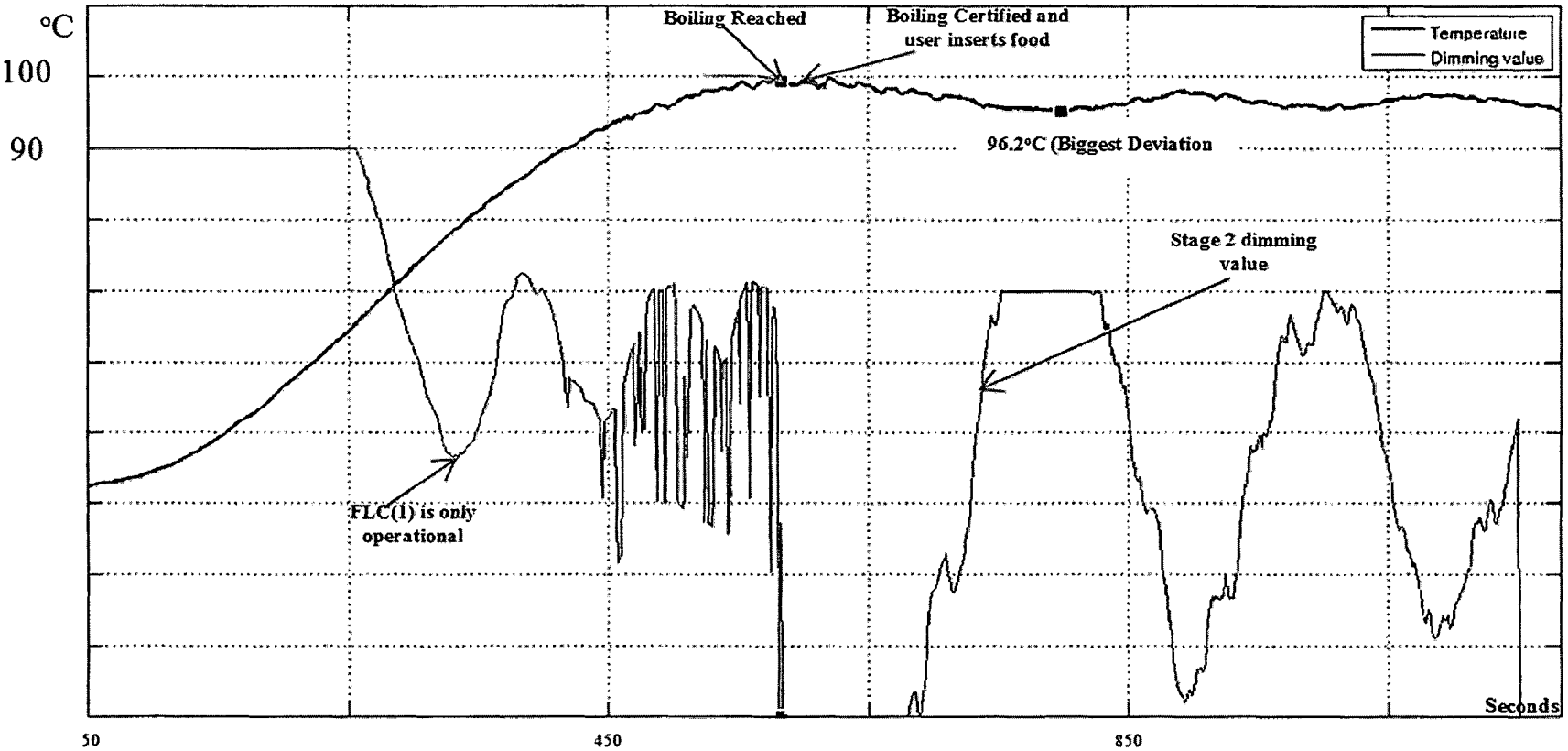
FIG. 14*a* shows the water temperature and output duty cycle during a boiling experiment and FIG. 14*b* shows a temperature inside a pan with commanded dimming output during a stir/shallow frying experiment.

For the boiling experiments, the users chose the boiling option and provided the desired boiling time through the GUI as shown in FIG. 13*b*. The system started heating the water to the boiling point and when the boiling temperature was reached, the system asked the user (via an audio message and through the GUI) to place the food in the cooking pot. The user then placed the food in the cooking pot (as shown in FIG. 13*c*) and when the cooking was finished the user was alerted to remove the cooked food from the pot. During the experiments, various water volumes, cooking times, pots, and foods to be cooked were tested. Also, half the experiments were performed using lids and the other half with no lids. FIG. 14*a* shows an example of the system dynamics for a boiling experiment (only one experiment is presented, however the other 39 experiments had the same behavior). FIG. 14*a* shows the actual temperature of the water measured by the dip probe thermometer and the dimming value commanded by Stage 2. The system started with FLC(1) until the boiling point was reached. After 30 seconds of boiling with a constant IR sensor reading, the boiling was certified and the user asked to insert the food in the pot to launch FLC(2). Once boiling was certified, the water temperature did not fall below 5° C. from the boiling temperature (the biggest deviation was 3.6° C.).

It is shown that before reaching the boiling point, FLC(1) allows fast and wide output variations to achieve the boiling point as quickly as possible, whereas after boiling is detected, Stage 2 dimming values cause smoother and smaller variations while achieving energy savings for areas where the dimming value is set to zero.

Figure 13D:
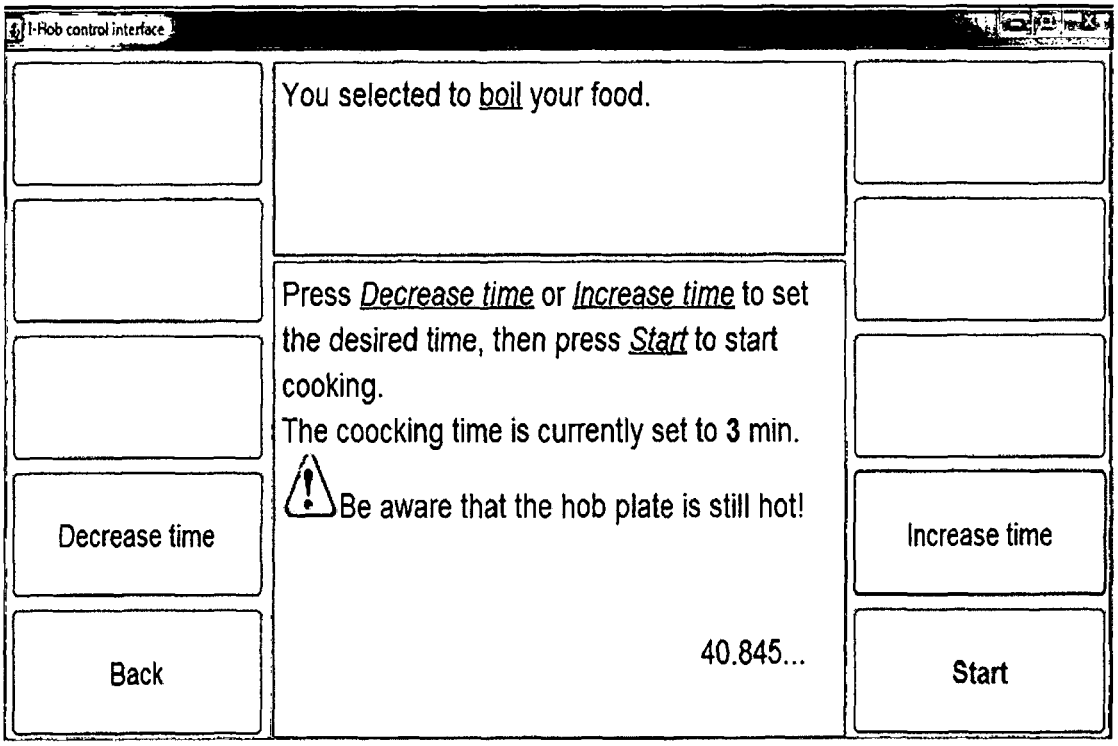
FIG. 13*d* shows a graphic user interface requesting the user to specify a pan-type during stir-frying.
Figure 14B:
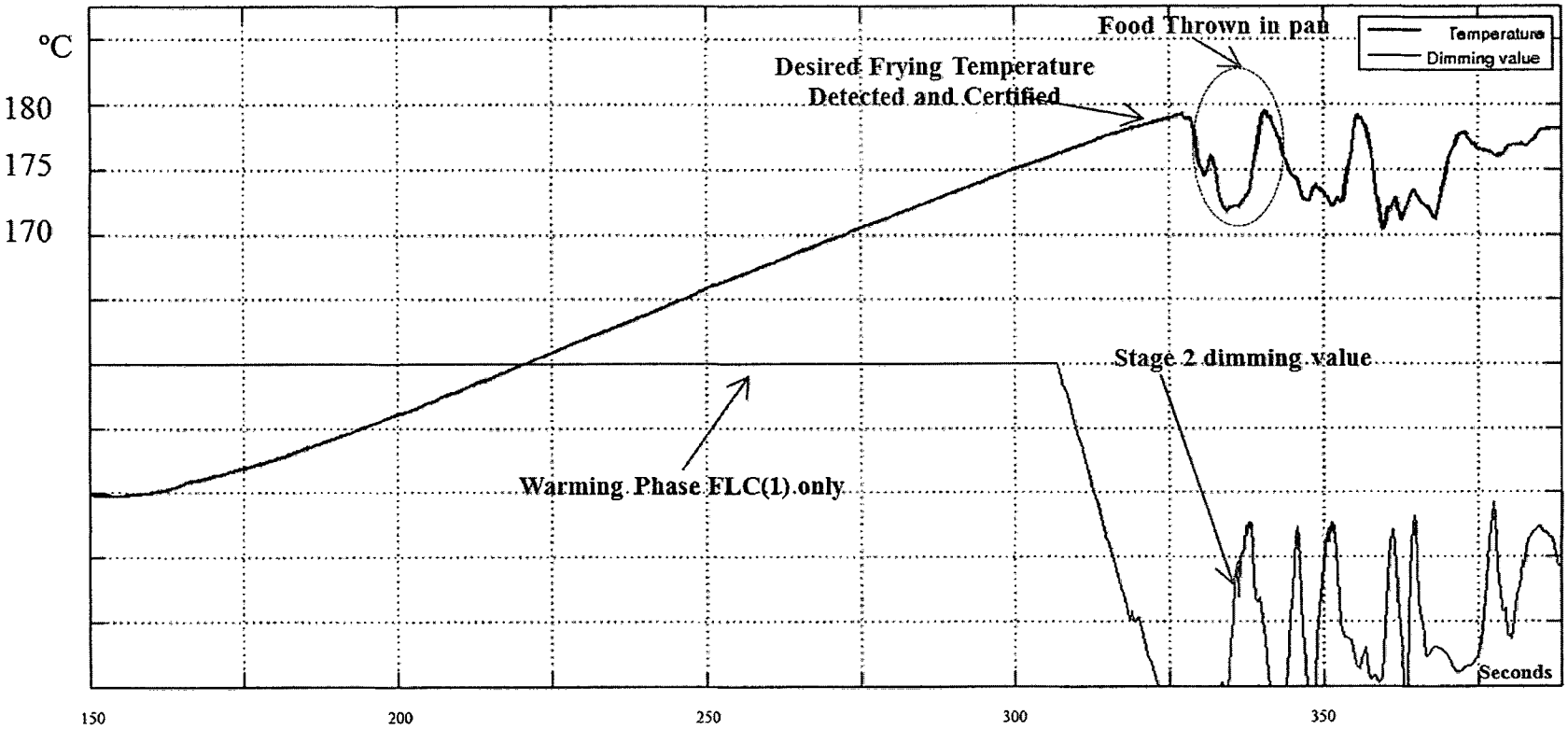
Figure 15A:
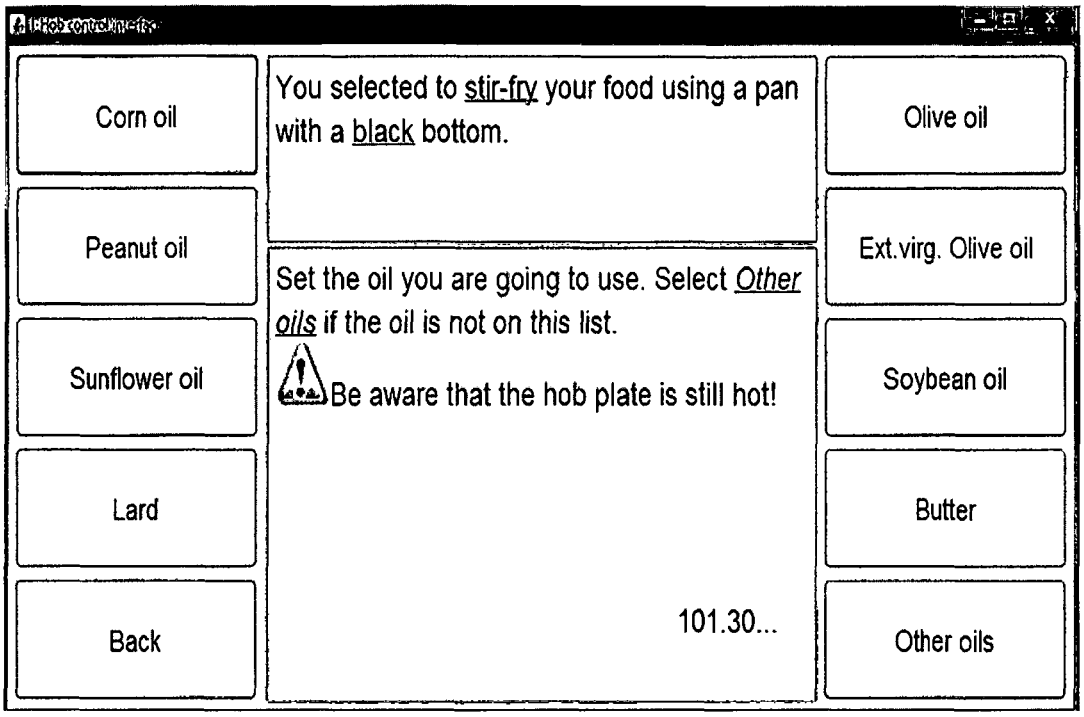
FIGS. 15*a* and 15*b* are graphic user interfaces.
Figure 15B:
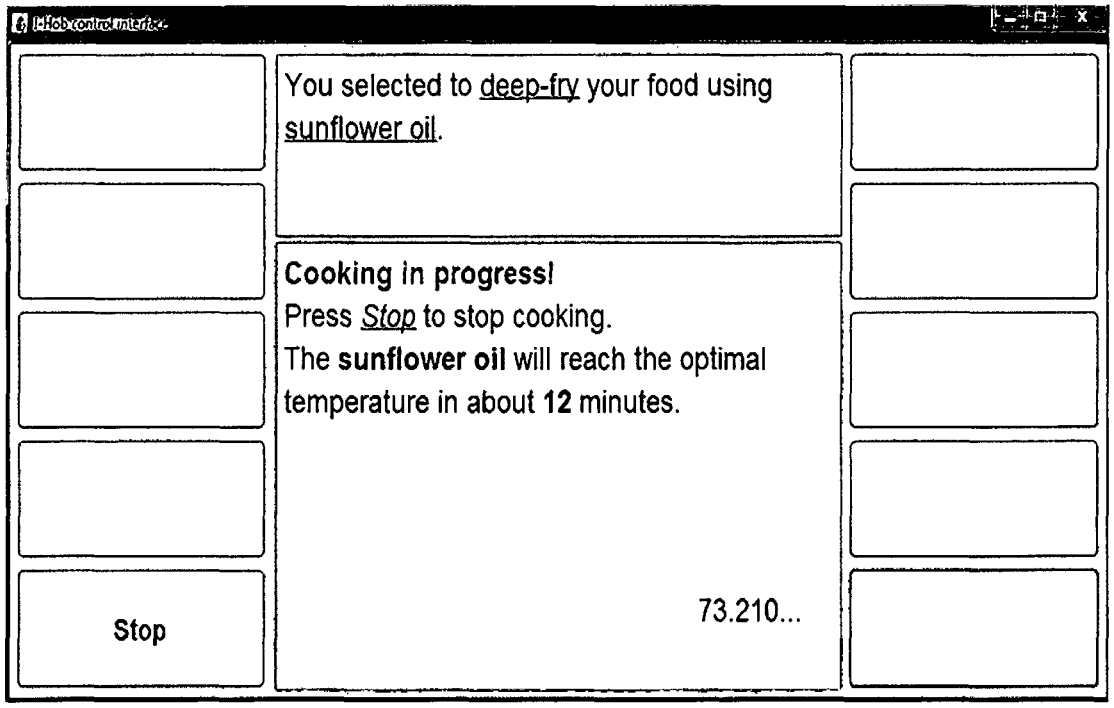
Figure 15C:
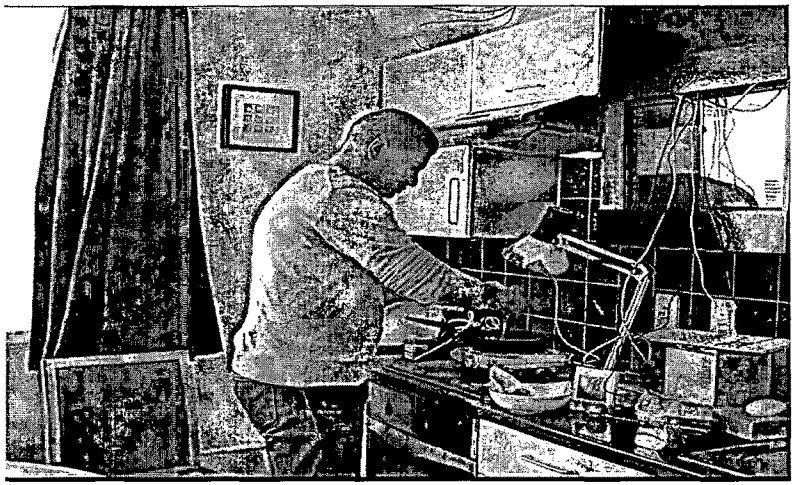
FIGS. 15*c* and 15*d* illustrate a user adding food to a pan in stir/shallow frying and deep frying respectively.
Figure 15D:
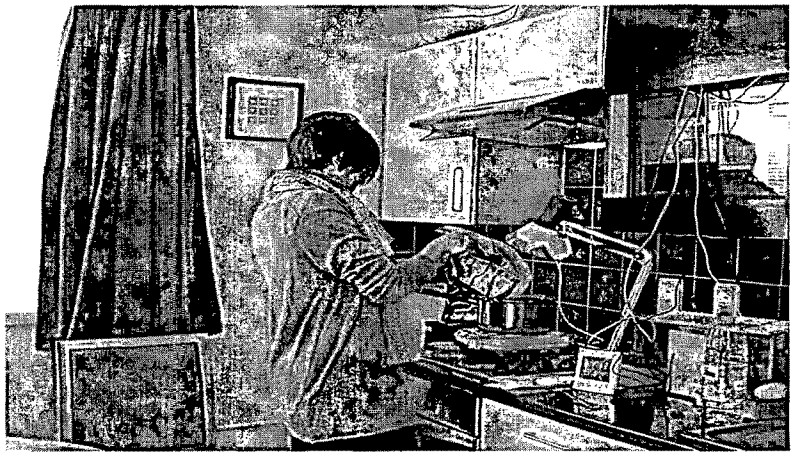

For the frying system, if stir/shallow-frying was chosen, the user first chose the pan type (as shown in FIG. 13*d*), whereas if deep-frying was chosen, the user needed first to select the oil/fat type (as shown in FIG. 15*a*). The user then selected the desired frying temperature and the system alerted the user to the estimated time needed to reach the desired frying temperature (as shown in FIG. 15*b*). The system then brought the oil to the desired frying temperature and then alerted the user (via an audio message and through the GUI) that the frying temperature had been reached and that the user was to supply the food to the pan. The user then added the food to the pan (as shown in FIG. 15*c* for stir/shallow-frying and in FIG. 15*d* for deep-frying). When the cooking was finished, the system alerted the user that the food was ready for collection. The frying experiments were conducted with various foods and the deep-frying experiments were conducted with different volumes of nine different oils or fats. The stir-frying tests were conducted using the types of pans shown in FIG. 9*b*. The frying experiments verified that the system can bring the oil/fat to the requested frying temperature and the system can maintain the requested frying temperature within a 10° C. range during the whole frying process. To verify the actual frying temperatures, an industrial hand-held thermocouple was used. FIG. 14*b* shows a stir/shallow frying experiments where the desired frying temperature was 178° C. As can be seen in FIG. 14*b*, FLC(1) started the warming phase till the desired frying temperature was reached (178° C.) and certified at which point the user was asked to add the food to initiate FLC(2). The deep frying followed a similar dynamic to FIG. 14*b*.

To verify the energy consumption of the system, during each experiment, the heating was driven manually by the user and by the proposed intelligent system with the order chosen at random in order not to bias the system energy consumption comparisons with the manual operation results. As can be seen from FIG. 14 (and as shown to the user through the energy monitor), the situations when the dimming output reaches zero are correlated to the potential energy savings. Hence, the system delivers quality cooked food in the same time as the normal user but with significant energy savings. The results of FIG. 16 quantify the energy savings of the systems where it is shown that over the 40 experiments, when compared to the user manual operation the boiling system achieves an average energy saving of 21.42% with a standard deviation of 3.7 and the stir-frying system achieves an average energy saving of 34.43% with a standard deviation of 5.2 and the deep-frying achieves an average energy saving of 20.29% with a standard deviation of 2.7.

Forty users have performed different tests to verify the proper functionality of each of the safety checks which include: if the system can detect the pan boiling-dry event, if the system detects when the pan reaches a temperature above 250° C. and if the system is able to verify if the appliance is left ON without any pot/pan for more than 30 seconds and if the heating plate is above 40° C. when no pan is present on it. The system has two other warnings with the aim of helping the user to cook more healthily during frying. The first warning tells the user to stop adding food into the pan when the temperature of pan (measured by TC) goes below the target temperature for more than 20° C. The second warning alerts the user when the stir-fry is above the smoking point of the used oil. The system has always produced the correct alerts at the correct situations. Hence, the system implements safety checks not present in commercial appliances.

The above-disclosed system is particular suitable for use in conjunction with voice-operated commands from the user. In particular, employing the most widely used inter-human communication, which is spoken language, in intelligent appliances can facilitate a natural communication between the users and the computers. The paradigm of Computing With Words (CWWs) is utilized in which a natural form of communication is incorporated by mimicking inter-human reasoning in computer processes. CWWs use 'words' in computing; yet, words mean different things to different people and this causes linguistic uncertainty. In order to deal with the linguistic uncertainty, various approaches using type-1 and interval type-2 (IT2) fuzzy sets to model words have been proposed.

Figure 18A:
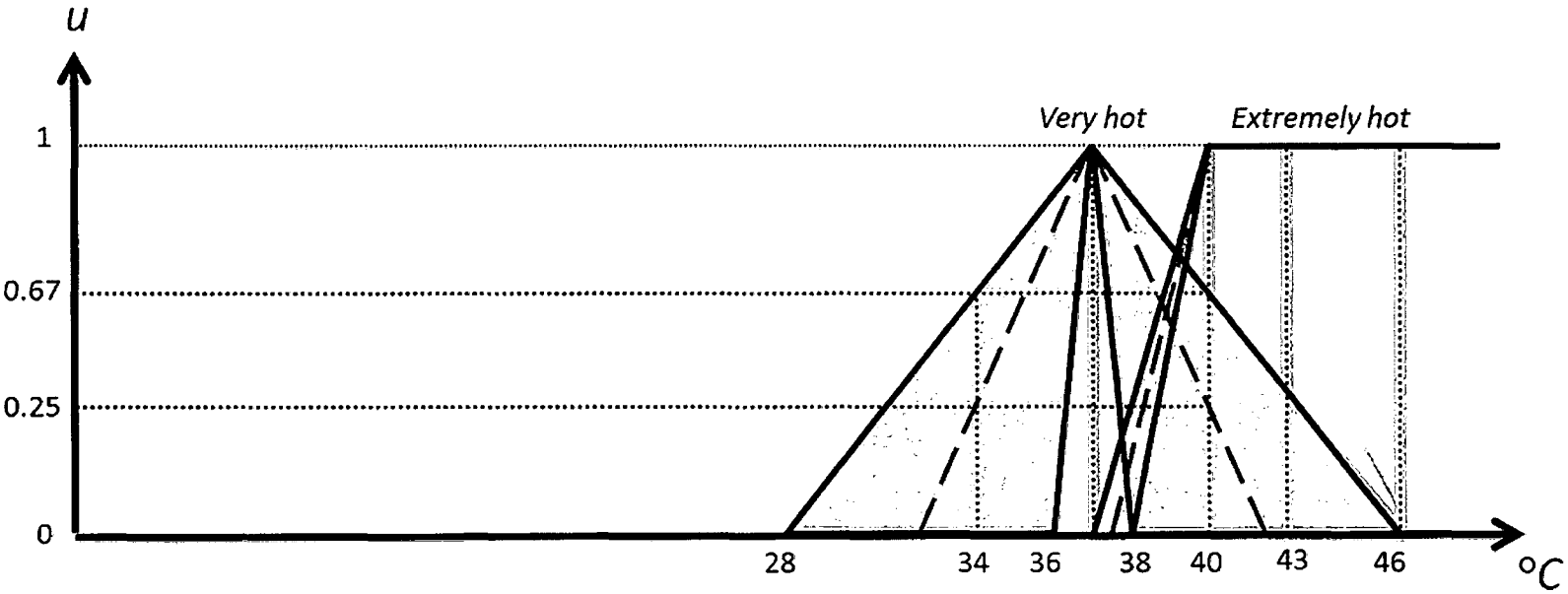
FIG. 18*a* illustrates difficulties with 112 fuzzy sets and FIG. 18*b* is a high level schematic of a system.
Figure 18B:
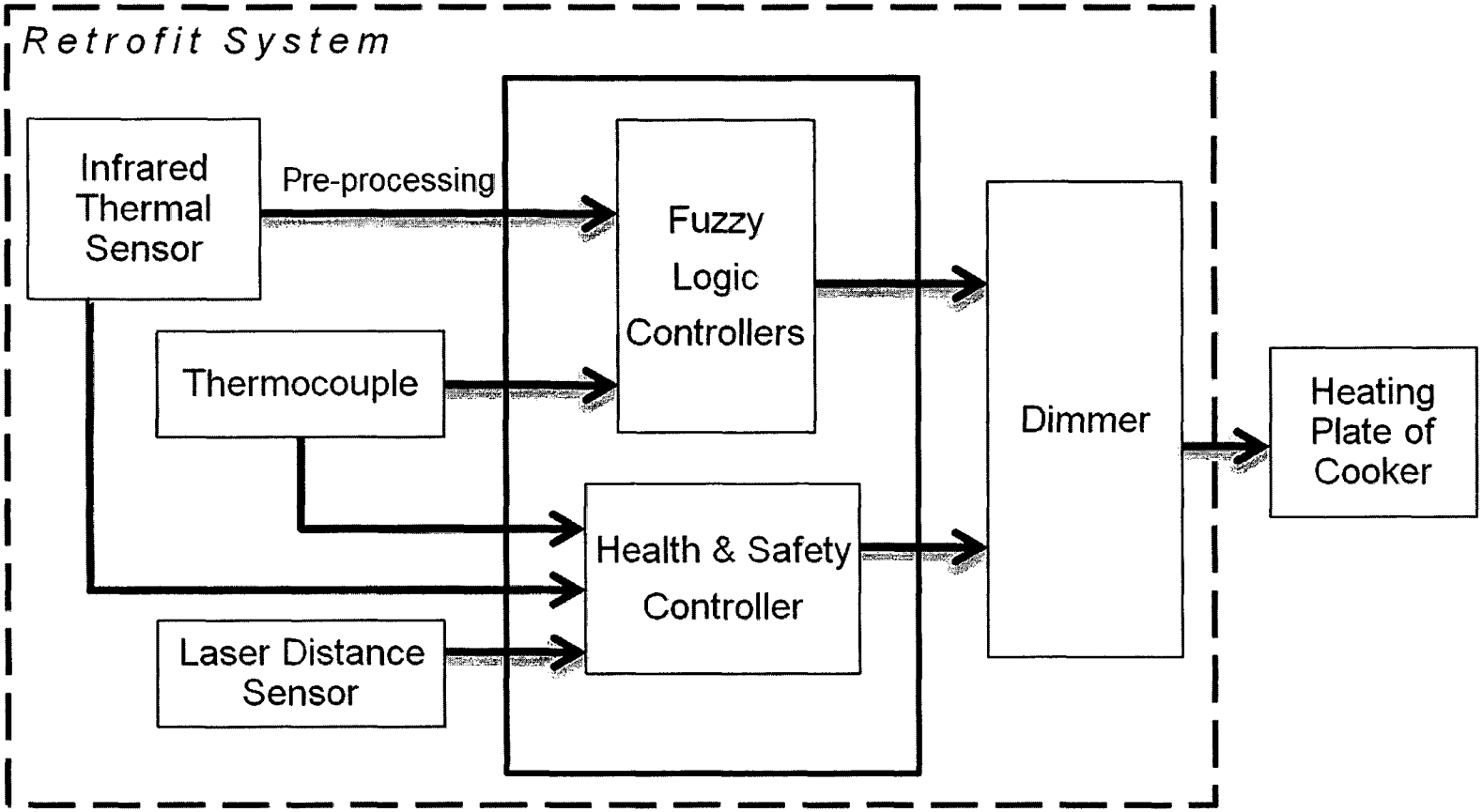

However, the existing approaches show inadequacies in preserving the natural ordering between numbers which can lead to incoherencies in the models representing words in natural language. FIG. 18*a* shows a situation where x'=40° C. and x"=43° C. and both x' and x" have a membership value of 1 to the linguistic label Extremely hot (when either type-1 or 112 fuzzy sets are employed). The same applies to the temperature values of 34° C. and 40° C. which will have the same type-1 and 112 membership values to the linguistic label Very hot. Hence, from the machine point of view, there is no way to distinguish between x' and x" (although the difference can be perceived by humans) as they belong to the same linguistic label with the same membership degrees. As a result, by using type-1 or IT2 fuzzy sets, we might lose essential information. For overcoming such shortcomings of type-1 and IT2 fuzzy sets in modeling words, we use a novel General Type-2 (GT2) Fuzzy Logic based CWWs approach.

The system which integrates the intelligent cooker retrofit and the computing with words platform can be termed the Ambient Intelligent Food Preparation System (AIFPS)

Figure 17:
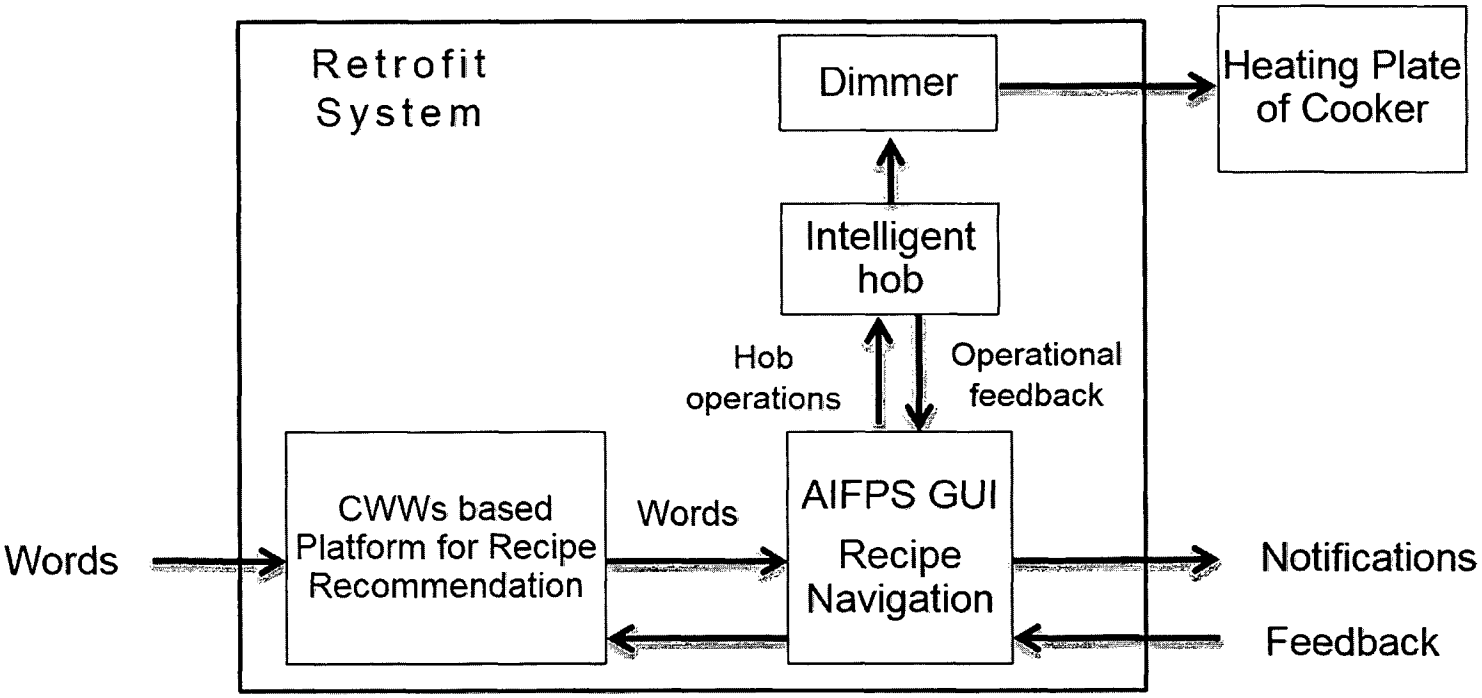
FIG. 17 shows the architecture of a retrofit system.

The architecture of the proposed AIFPS is presented in FIG. 17. As can be seen, AIFPS integrates two major systems which are CWWs-based platform for recipe recommendation and intelligent cooker. The graphical user interface (GUI) of AIFPS offers a visual representation of the recipe navigation as the AIFPS runs on Nuance's VoCon® 3200 engine based Speech-Driven Dialogue System developed for the iSpace. Below, is presented the details of CWWs-based platform for recipe recommendation, which understands the needs of the user and provides recipes. The Intelligent hob, which offers safe and automated cooking, is shown in FIG. 2 in real-world settings and is also described below.

A. CWWs-Based Platform for Recipe Recommendation

The inputs to the AIFPS system are words which indicate the user's mood, appetite and spare time. These words are represented by a novel modeling approach using Linear General Type-2 (LGT2) fuzzy sets and are passed to the CWWs Framework which is presented in detail in FIG. 19*a*. The objective of the deployed CWWs Framework is to enable the computers to understand humans as if the user were communicating with another human being in the course of rather complex reasoning and problem solving.

Figure 19A:
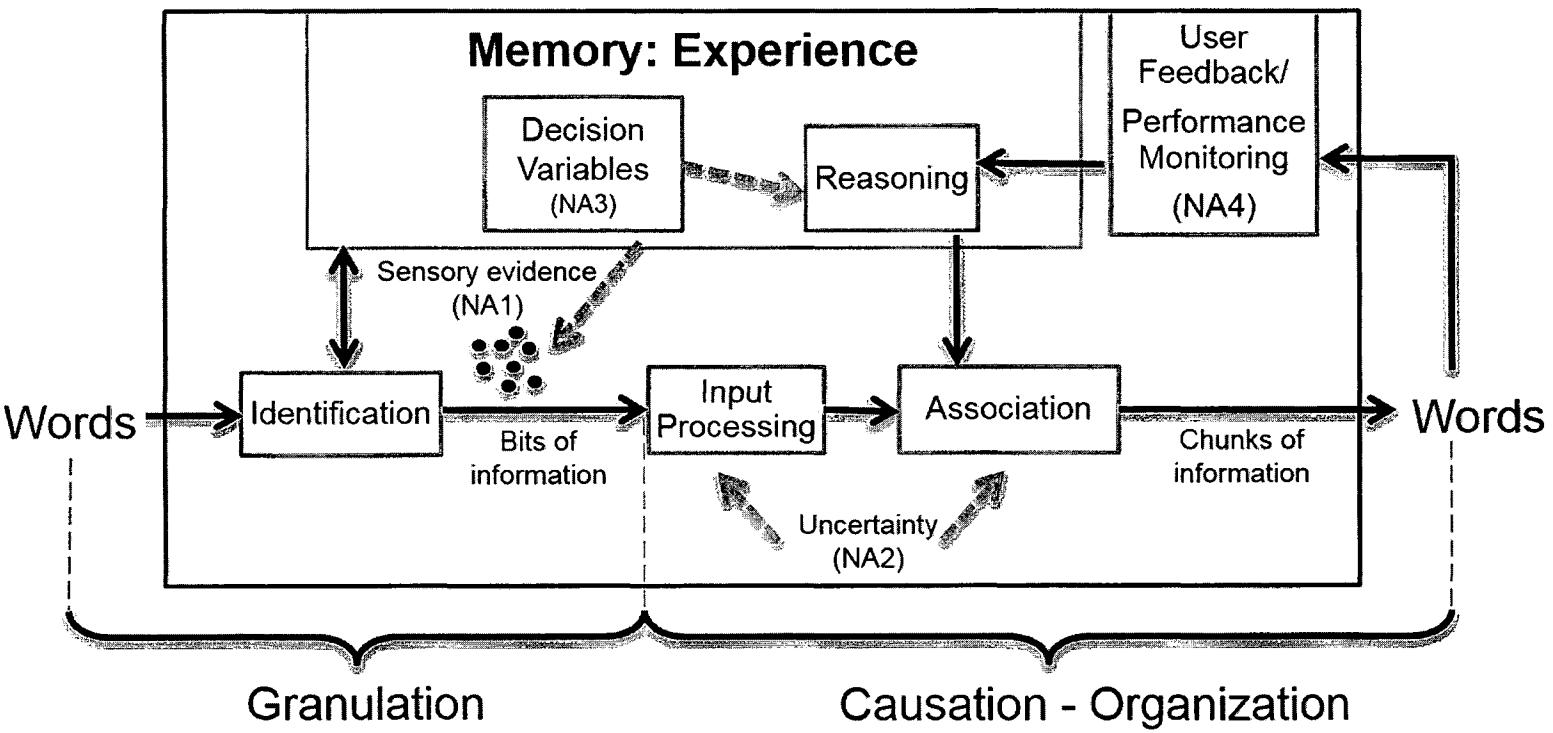
FIG. 19*a* shows the architecture of a GT2 fuzzy logic system and FIG. 19*b* illustrates the use of antonyms in linguistic labels.

There is maintained to be a connection between the machinery of fuzzy logic and human reasoning, and the concepts underlying the human cognition can be grouped into three: granulation, organization and causation. These concepts are informally defined as follows: granulation involves decomposition of the whole into parts; organization involves integration of parts into a whole; and causation involves association of causes with effects. As shown in FIG. 19*a*, the CWWs Framework is divided into two segments, which are granulation and causation-organization.

The neural architecture for perceptual decision-making can be viewed as a system that consists of four distinct but interacting processing modules which are NA1 in FIG. 19*a* that accumulates and compares sensory evidence; NA2 in FIG. 19*a* that detects perceptual uncertainty or difficulty; NA3 in FIG. 19*a* that represents decision variables; and NA4 in FIG. 19*a* that is involved in performance monitoring by detecting when errors occur and when decision strategies need to be adjusted to maximize performance. It can be deduced from that accumulation of sensory evidence requires some sort of storage/memory. In the deployed CWWs Framework, the neural architecture of perceptual decision making and the notion of memory (experience) has been incorporated as shown in FIG. 19*a*.

The operation of the CWWs Framework is as follows: input words represent a problem that needs to be answered/solved and to do this; in the granulation segment, the input words are first granulated by being mapped into sensory evidence of a remembered solution in the human experience. The sensory evidence retrieved from the memory is regarded to be descriptors of a solution that relates to the decision variables in human reasoning and are represented numerically. For example, on an ordinary weekday, a person can come home from work tired and very hungry and needs to prepare something very easy considering their status. The interpretation of the term 'very easy' depends on some criteria which happen to be the preparation time and the cooking time of the recipe. Accordingly, the problem descriptors in this case are tiredness and hungriness (in words), whereas the solution descriptors are preparation time and cooking time of the recipe in minutes (hence numerical). In other words, the identification element takes tiredness and hungriness in words and outputs bits of information for preparation time and cooking time in numbers.

Next is the causation-organization segment in the deployed CWWs Framework. As human reasoning is done using natural language, the numerical sensory evidence is converted into words by input processing element so that the bits of information are classified to cope with the uncertainty associated to it in the human mind. The mapping of sensory evidence is done using fuzzy representations of the decision variables that characterize the human reasoning, which is represented in IF-THEN fuzzy rule format. For example, the decision variables in the previously mentioned scenario are preparation time and cooking time (linguistic variables), which have fuzzy representations using the linguistic labels 'short' vs. 'long' for the preparation time, and 'quick' vs. 'slow' for the cooking time. Moreover, the solution is described by the difficulty level of the recipe and has a fuzzy representation using the linguistic labels 'challenging' vs. 'easy'. So, in this scenario, the human reasoning is represented using fuzzy rules such as 'If preparation time is short and the cooking time is very quick then the difficulty level of the recipe is very easy'. Depending on the numerical inputs (bits of information), active rules are found by the association element and the output is drawn by first aggregating active rules into an interval format and then generalizing this interval into chunks of information (words) to be communicated back to the user through the AIFPS GUI. This concludes the one way information flow of causation-organization segment. For example, in the previous scenario, the user is given suggestions to cook very easy recipes which are recommended based on the experience and reasoning tailored to him/her. After the solution is presented to the user, for performance monitoring purposes, the output word needs to be evaluated by the user so that the CWWs Framework can learn and adapt. This is also illustrated in FIG. 17 as 'Feedback' that is taken through the AIFPS GUI. For example, the user is asked to provide words for preparation time and cooking time as well as the difficulty level of the recipe in his/her opinion. Upon receiving this feedback, the human reasoning which is in the form of IF-THEN rules can be modified to incorporate the incoming information.

As can be seen in FIG. 19*a*, the identification element of the deployed CWWs' Framework deals with the process of decomposing the word (perception, linguistic label) into sensory evidence, that is numerical sensory information. The approach taken to implement granulation is by using Case Based Reasoning (CBR) which is inspired from human problem solving behaviors. Consequently, words input to the CWWs Framework constitute representation of a 'problem' specification in CBR, and the 'solution' to this problem is retrieved from memory in similar fashion to a human remembering a past experience.

Based on neuroscience review of human perceptual decision making, the information retrieved from the memory is mimicked to be in a numerical format. After the words are granulated, the input processing element processes the numerical information and the association element mimics human reasoning using the decision variables that influence the formation of perceptual judgments. The approach taken to implement the causation-organization segment is by using Fuzzy Composite Concepts (FCCs that aim to generalize and integrate a wide range of sources of information into concepts as done by humans in a natural and pervasive manner). While mimicking human reasoning in computer processes, the causation-organization segment also deals with the uncertainty that needs to be handled in forming perceptual judgments. Mainly, the causation-organization segment integrates the resultant information involving cause and effect of the decision variables, which originates from the human experience, in a chunk of information (i.e. words, perceptions). This segment also involves performance monitoring, which is taking user feedback on the perceptual judgment and the decision variables. Hence, any modification or adaptation is handled by this segment and it is very essential for learning and adaptation capabilities of the CWWs Framework.

The technical details of LGT2 fuzzy sets, which play an important role in providing a natural communication between the humans and the computers, are explained further in the subsection below.

Linear General Type-2 Fuzzy Sets (LGT2 FSs)

LGT2 FSs are inspired by the need to create adequate models that are capable of representing 'words' to capture a human's perceptions. In the literature, some studies show the inconsistencies of modelling words using type-1 and IT2 fuzzy logic. It has been put forward that it is possible to lose the natural ordering on the real numbers in fuzzy semantics. The fuzzy logic referred to here is type-1 fuzzy logic. Formally, for all x, $x' \epsilon X$, $\mu_{Extremely\ hot}(x)=\mu_{Extremely\ hot}(x')$, if x is exactly as Extremely hot as x'. If the claim "43° C. is hotter than 40° C." is to be interpreted in fuzzy semantics using the information $\mu_{Extremely\ hot}(40)$ and $\mu_{Extremely\ hot}(43)$, a then the following relationship $\mu_{Extremely\ hot}(43)>\mu_{Extremely\ hot}(40)$ where > is the natural ordering on the real numbers would be set. But this conflicts with the reasonable assumption that if the temperature$_x$ reaches a certain value, say 40° C., then x is definitely Extremely hot and hence $\mu_{Extremely\ hot}(40)=1$ (the case of shoulder membership functions (MFs)). Hence, $\mu_{Extremely\ hot}(40)=\mu_{Extremely\ hot}(43)$, and the claim "43° C. is hotter than 40° C. is" comes out false. Furthermore, it has been shown it is possible to generate a number of incompatible statements using IT2 fuzzy logic. For example, in crisp logic, the statement S=(The perpetrator is tall.) is equivalent to the below statement:

$S_{crisp}$=('The perpetrator is tall.' is true.)

On the other hand, in type-1 fuzzy logic, the statement S can take the form of:

$S_{type\text{-}1}$=('The perpetrator is tall.' has a truth value of 0.8.)

whereas in IT2 fuzzy logic, the statement S can take the following forms:

$S_{IT2}$=(The statement ('The perpetrator is tall.' has a truth value of 0.8) has a truth value of 1.)

$S_{IT2}'$=(The statement ('The perpetrator is tall.' has a truth value of 0.5) has a truth value of 1.)

Hence, the statements $S_{IT2}$ and $S_{IT2}'$ are inconsistent and the examples above show how an IT2 fuzzy set can generate a number of incompatible statements. In the case of modeling statements using general type-2 (GT2) fuzzy logic it has been held that the statements $S_{GT2}$ and $S_{GT2}'$ would be consistent as follows:

$S_{GT2}$=(The statement ('The perpetrator is tall.' has a truth value of 0.8) has a truth value of 1.)

$S_{GT2}'$=(The statement ('The perpetrator is tall.' has a truth value of 0.5) has a truth value of 0.6.)

Consequently, the use of GT2 fuzzy logic to overcome the shortcomings of type-1 and IT2 fuzzy logic when modelling words for CWWs has been investigated.

One of the most important characteristics of GT2 fuzzy sets is the additional degrees of freedom, which can enable handling higher uncertainty levels. The present invention contemplates a novel kind of GT2 FSs termed Linear General Type-2 Fuzzy Sets. The theoretical formulation of LGT2 FSs is based on linear adjectives and antonyms. From the linguistics perspective, the words (i.e. linguistic labels for linguistic variables) used in fuzzy logic are possibly adjectives (e.g. hot, cold, high, low, etc.), which have the distinctive characteristic of gradability as they are modeled in a sortal range within their mathematical domain. Formally, given that A is an adjective, two types of adjectives are put forward classified according to the following condition: "Whenever c is a context of use, $NP_1$, $NP_2$ denote individuals within the sortal range of A, then the sentence $NP_1$ is A-er than. $NP_2$ has a definite truth value in c.". Accordingly, the linear adjectives are those that satisfy this condition and the ones that do not are called to be nonlinear. For example, let c be a context of temperature, $NP_1$=43 and $NP_2$=40 within the sortal range of 'hot', then the sentence "43 is hot(t)-er than 40" has a definite truth value in temperature context; therefore, 'hot' is a linear adjective as it satisfies the above condition.

Figure 19B:
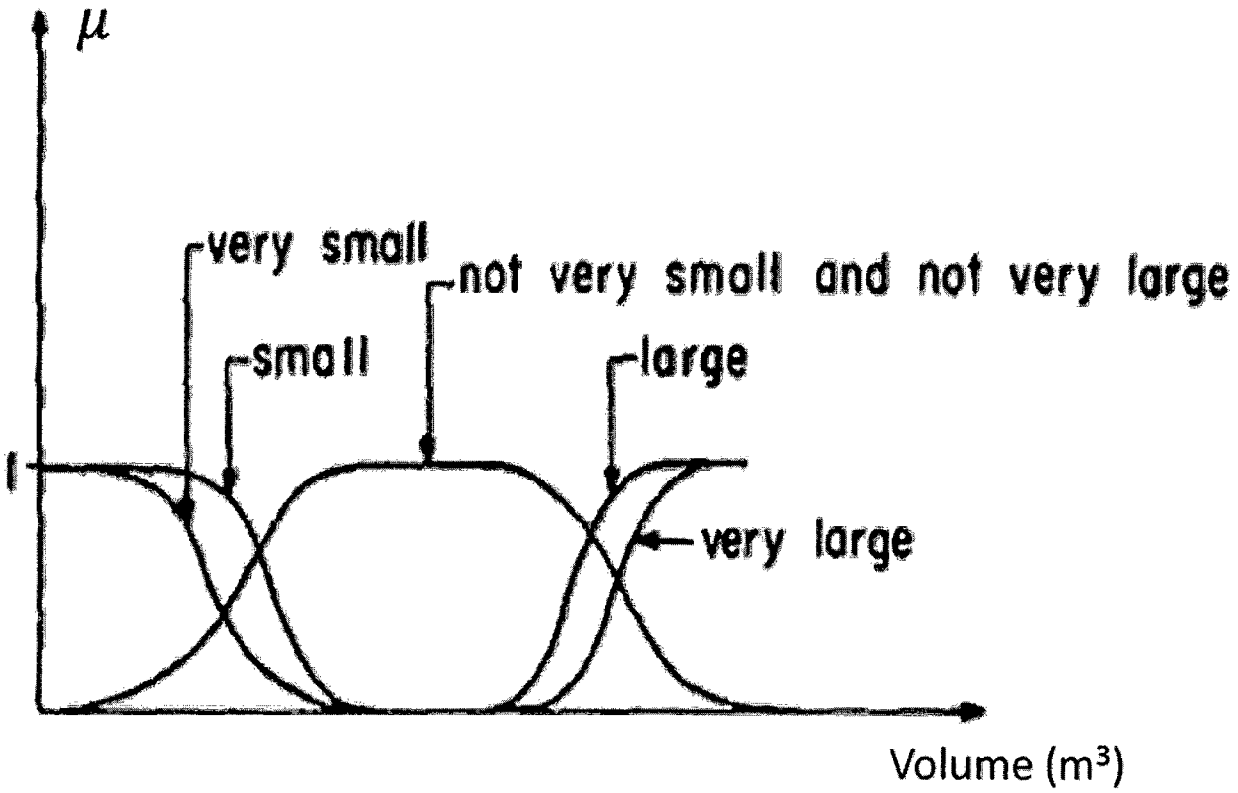

Moreover, antonyms are regarded to be an important phenomenon of language needed for building up linguistic variables in fuzzy logic. Nested FSs can be used where the linguistic labels (i.e. small and large) represent the two opposite sides of a phenomenon, and the modifiers (i.e. very, not very), which are used to intensify or weaken the meaning of a word, are nested in the type-1 primary membership functions of the antonyms (see FIG. 19*b*). Additionally, antonyms can provide an insight to the operation of the human mind with regards to making perceptual judgments, which is a matter of deciding between two opposite sides (e.g. hot and cold, good and bad, etc.). Moreover, it has been maintained that, " . . . many words are better managed once we have used pairs of words (P, opposite of P)."

Figure 20A:
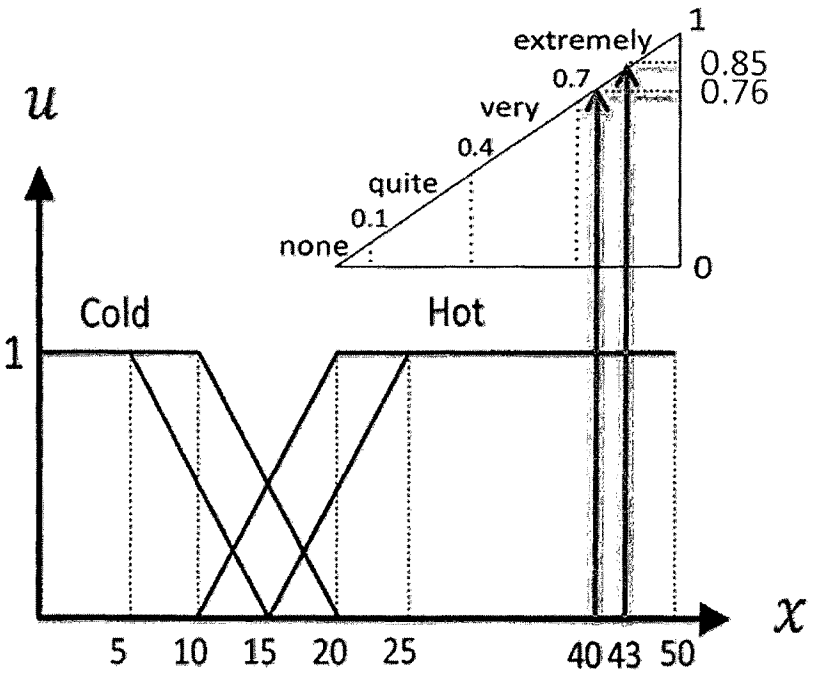
FIG. 20*a*-20*c* illustrate LGT2 FS and functions and geometry associated therewith.
Figure 20B:
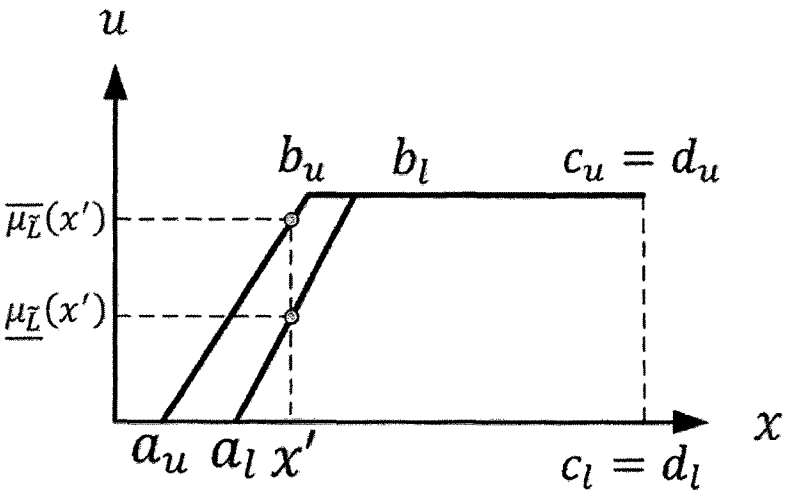
Figure 20C:
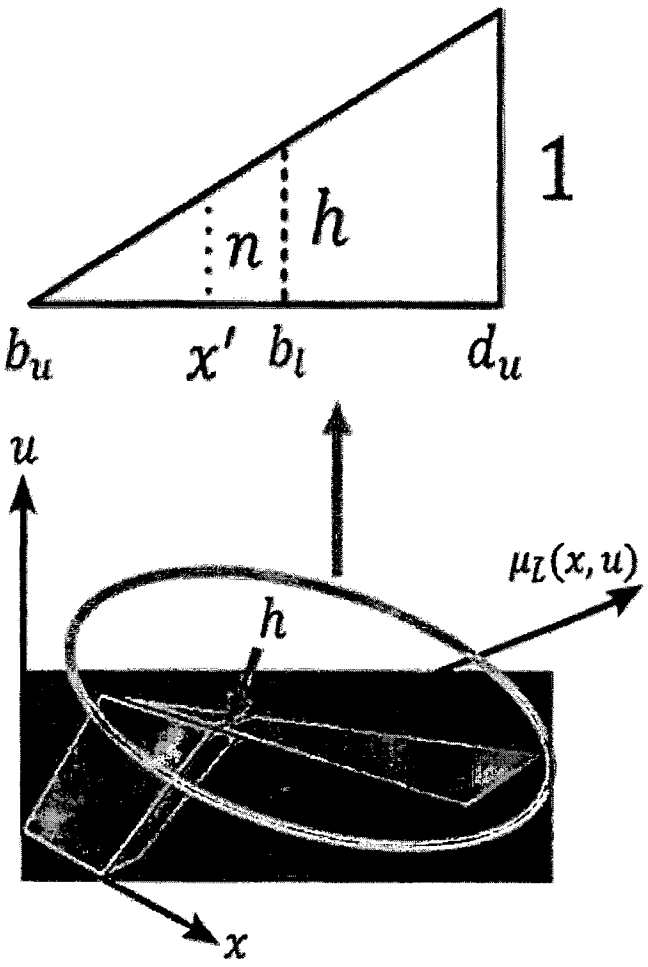

Consequently, for modeling the linguistic labels, the linguistic variables are clustered into two opposite sides (i.e. antonyms) by using two shoulder (left and right) trapezoidal membership functions as shown in FIG. 20*a*; and for the modeling the linguistic modifiers, a nested way is proposed but instead of designing primary memberships for all the linguistic modifiers, the design of secondary memberships is proposed using GT2 FSs as shown in FIG. 20*a* and FIG. 20*c*.

Formally, a type-2 FS, denoted $\tilde{A}$, can be expressed as follows:

$$\tilde{A}=\int_{x\in X}\int_{u\in J_x}\mu_{\tilde{A}}(x,u)/(x,u)\ J_x\subseteq[0,1] \tag{1}$$

Likewise, a Linear General Type-2 FS denoted $\tilde{L}$ (see FIG. 20*c*) can be expressed as follows:

$$\tilde{L}=\int_{x\in X}\int_{u\in J_x}\mu_{\tilde{L}}(x,u)/(x,u)\ J_x\subseteq[0,1] \tag{2}$$

FIG. 20*b* shows the primary membership of the right shoulder LGT2 FS and its associated representation points. FIG. 20*c* shows the points associated with the third dimension.

Figure 21A:
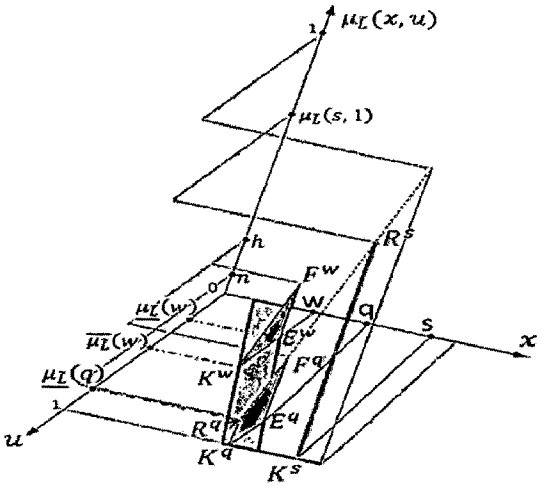
FIGS. 21*a*-21*d* illustrate slices taken through a right-shoulder LGT2 FS.
Figure 21B:
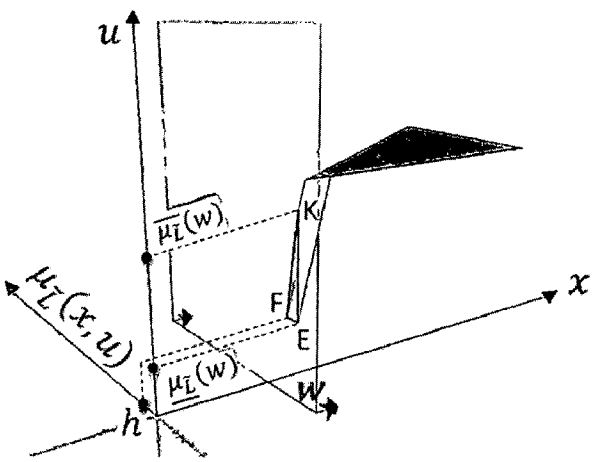
Figure 21C:
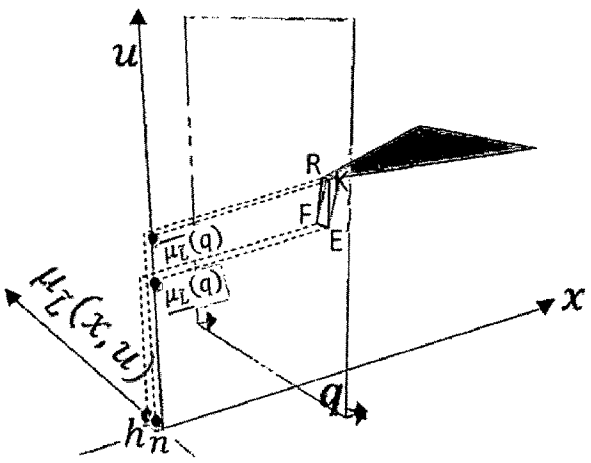
Figure 21D:
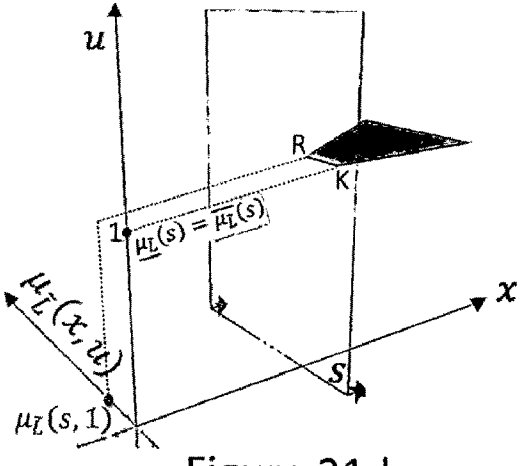

FIG. 21*a* shows a 3D diagram showing the vertical slices produced at the points w, q and s. FIGS. 21*b*-21*d* show more illustrations which use a section plane that cuts through the LGT2 FS slicing it vertically to show the resulting secondary membership. The three singleton inputs w, q and s, are selected to display all the possible vertical slice representations for any input within the universe of discourse.

A vertical slice of $\mu_{\tilde{L}}(x,u)$ at x=x' can be formalized as follows: let the primary membership of $\tilde{L}$ be represented by a shoulder Upper Membership Function (UMF) (type-1) whose parameters are denoted as $[a_u,b_u,c_u,d_u]$ and a Lower Membership Function (LMF) (type-1) whose parameters are denoted as $[a_l,b_l,c_l,d_l]$ where $c_u=d_u=c_l=d_l$ (as shown in FIG. 20*b*). By using similarity of triangles, as illustrated in FIG. 20*c*, the following equations can be written for the points h and n (marked in FIG. 21*a* along the $\mu_{\tilde{L}}(x,u)$ axis) as follows:

$$h=\frac{b_l-b_u}{d_u-b_u},\ h\in[0,1] \tag{3}$$

$$n=\frac{x'-b_u}{d_u-b_u} \tag{4}$$

$$\text{where } x'\geq b_u,\ n\in[0,1]$$

Note that h is a constant once the parameters of the UMF and LMF are known whereas n is dependent on x'. Furthermore, the vertical slices of inputs w, q and s in FIG. 21 are represented with a triangle having vertices $E^w$, $F^w$, $K^w$, a trapezoid having vertices $E^q$, $F^q$, $K^q$, $R^q$ and a singleton with height $R^s$, successively. In the mathematical formulation, the 3D coordinate system variables (x, u, $\mu_{\tilde{L}}(x,u)$) are used where the points E, F, K and R in 3D space (see FIG. 21) can be generalized letting x=x' as follows: E=(x',$\underline{\mu}_{\tilde{L}}(x')$,0), F=(x',$\vec{\mu}_{\tilde{L}}(x')$,h), K=(x',$\overline{\mu}_{\tilde{L}}(x')$,0) and R=(x',1,$\mu_{\tilde{L}}(x',1)$) (alternatively, R=(x',1,n)) where $\underline{\mu}_{\tilde{L}}(x')$ represents the lower membership degree and $\overline{\mu}_{\tilde{L}}(x')$ represents the upper membership degree of x'. The point value of $\mu_{\tilde{L}}(x',u)$ at u=u' can be written under three conditions depending on x':

Condition 1 ($x' \le b_u$) (see input w in FIG. 21*b*): $\mu_{\tilde{L}}(x',u')$ can be written as follows:

$$\mu_{\tilde{L}}(x', u') = \frac{h*(\overline{\mu_{\tilde{L}}}(x') - u')}{(\overline{\mu_{\tilde{L}}}(x') - \underline{\mu_{\tilde{L}}}(x'))} \quad (5)$$

where $x' \le b_u$

Condition 2 ($b_u < x' < b_l$) (see input q in FIG. 21*c*): $\mu_{\tilde{L}}(x',u')$ can be written as follows:

$$\mu_{\tilde{L}}(x', u') = \frac{h*(\overline{\mu_{\tilde{L}}}(x') - u') - n*(\underline{\mu_{\tilde{L}}}(x') - u')}{(\overline{\mu_{\tilde{L}}}(x') - \underline{\mu_{\tilde{L}}}(x'))} \quad (6)$$

where $b_u < x' < b_l$

Condition 3 ($x' \ge b_l$): (see input s in FIG. 21*d*): $\mu_{\tilde{L}}(x',u')$ can be written as follows:

$$\mu_{\tilde{L}}(x', u') = \frac{x' - b_u}{d_u - b_u} \quad (7)$$

where $x' \ge b_l$ and $u' = 1$.

Note that Equation (7) does not depend on u anymore due to the nature of the LGT2 FSs since the condition $x' \ge b_l$ marks the shoulder part of the FS where $\underline{\mu\tilde{L}}(x')=\overline{\mu_{\tilde{L}}}(x')=1$. Also, it is important to note that $b_l \ne b_u$ as the uncertainty bounds is predefined and conditions $b_u < b_l$ and $a_u < a_l$ hold for the creation of LGT2 FSs. Similarly, the parameters for the left shoulder LGT2 FS can be driven following the above procedure.

Figure 22A:
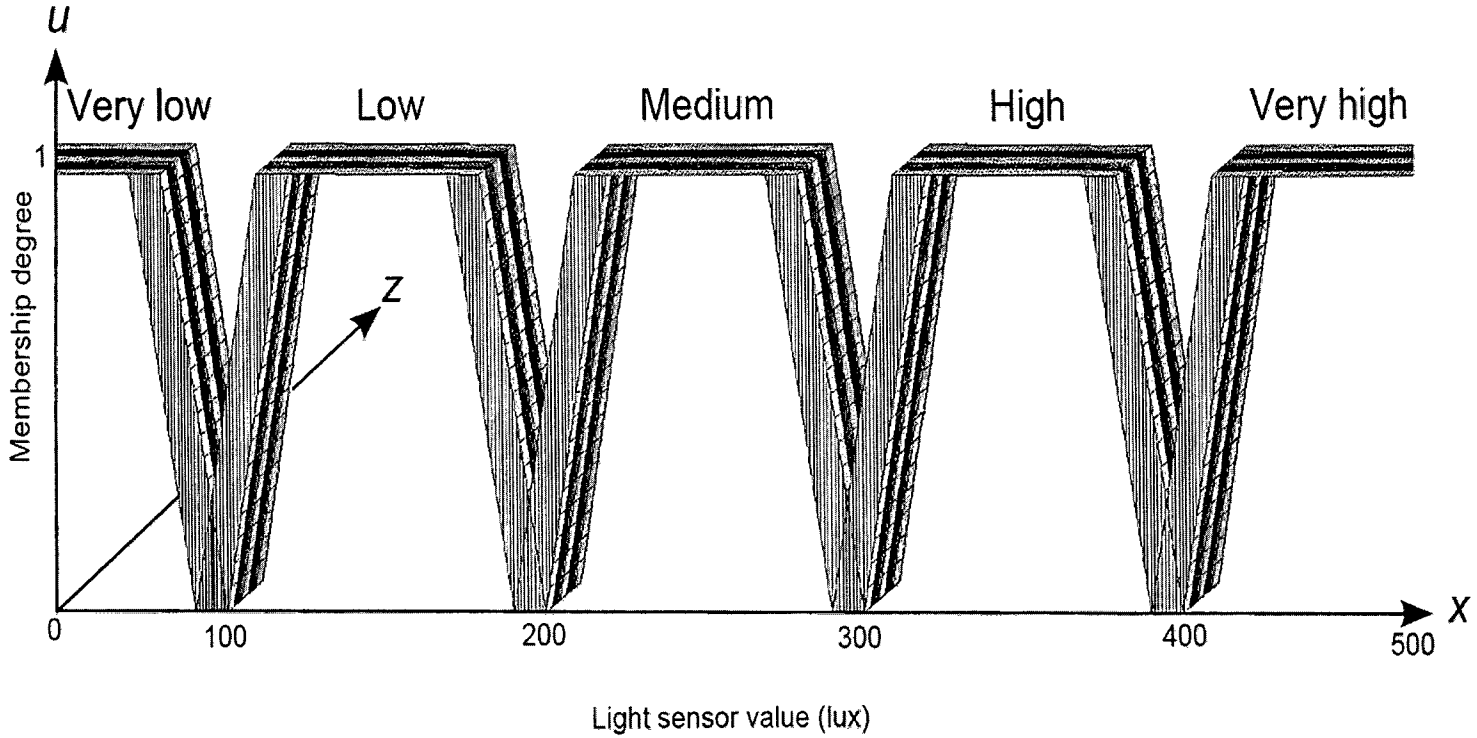
FIGS. 22*a* and 22*b* compare an IT2 and an LGT2 model.
Figure 22B:
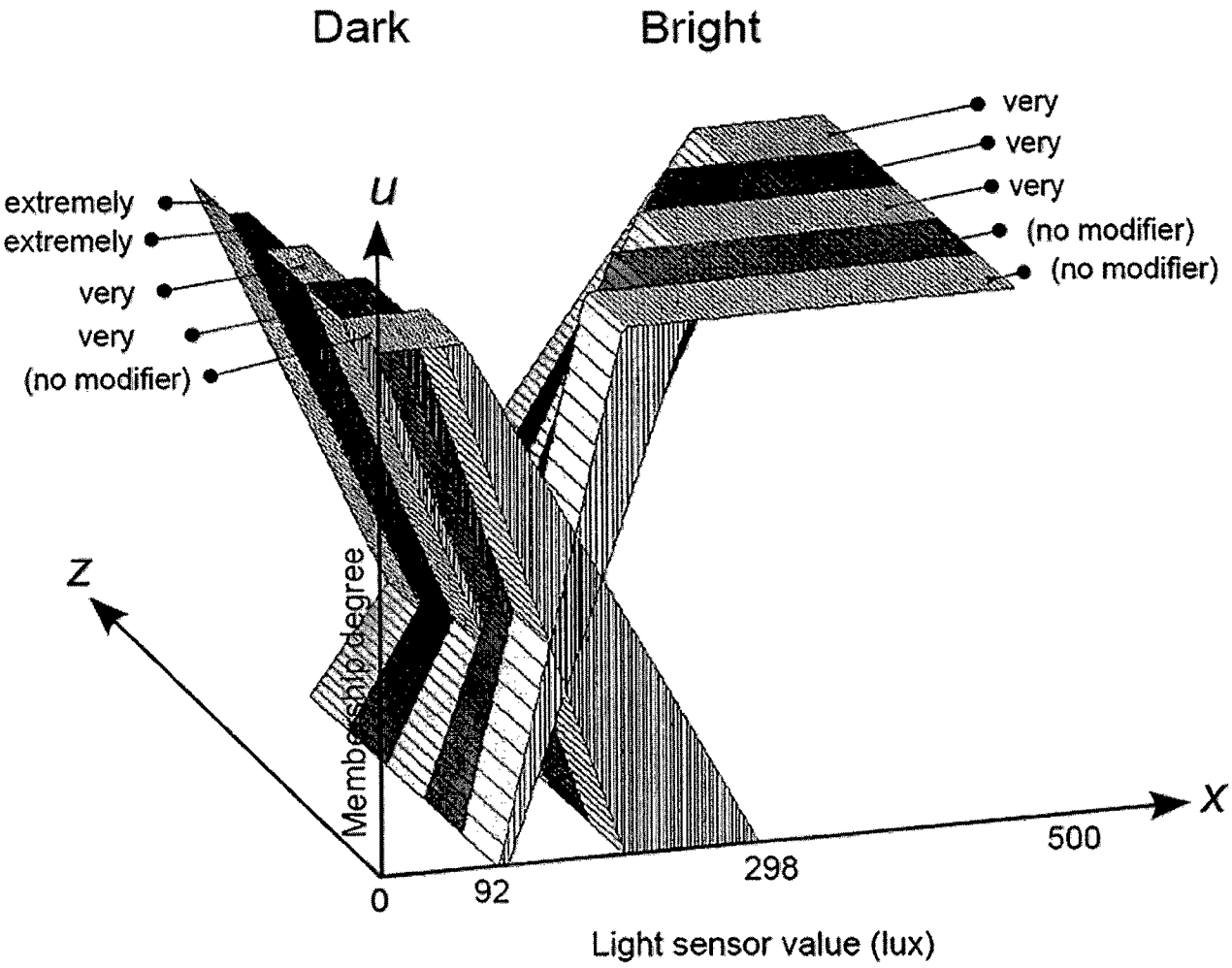

As mathematically shown above, the novelty of LGT2 FSs is to quantify the third dimension in a linear way where the modifiers (e.g. extremely, very, etc.) are nested for preserving the natural ordering. Hence, by nesting the Footprint of Uncertainties (FOUs) at different levels in the third dimension (see FIG. 22*b*), we can achieve the same level of profoundness as an IT2 model (see FIG. 22*a*) while simplifying the design of the linguistic variable and overcoming the inadequacies in word models.

Figure 23A:
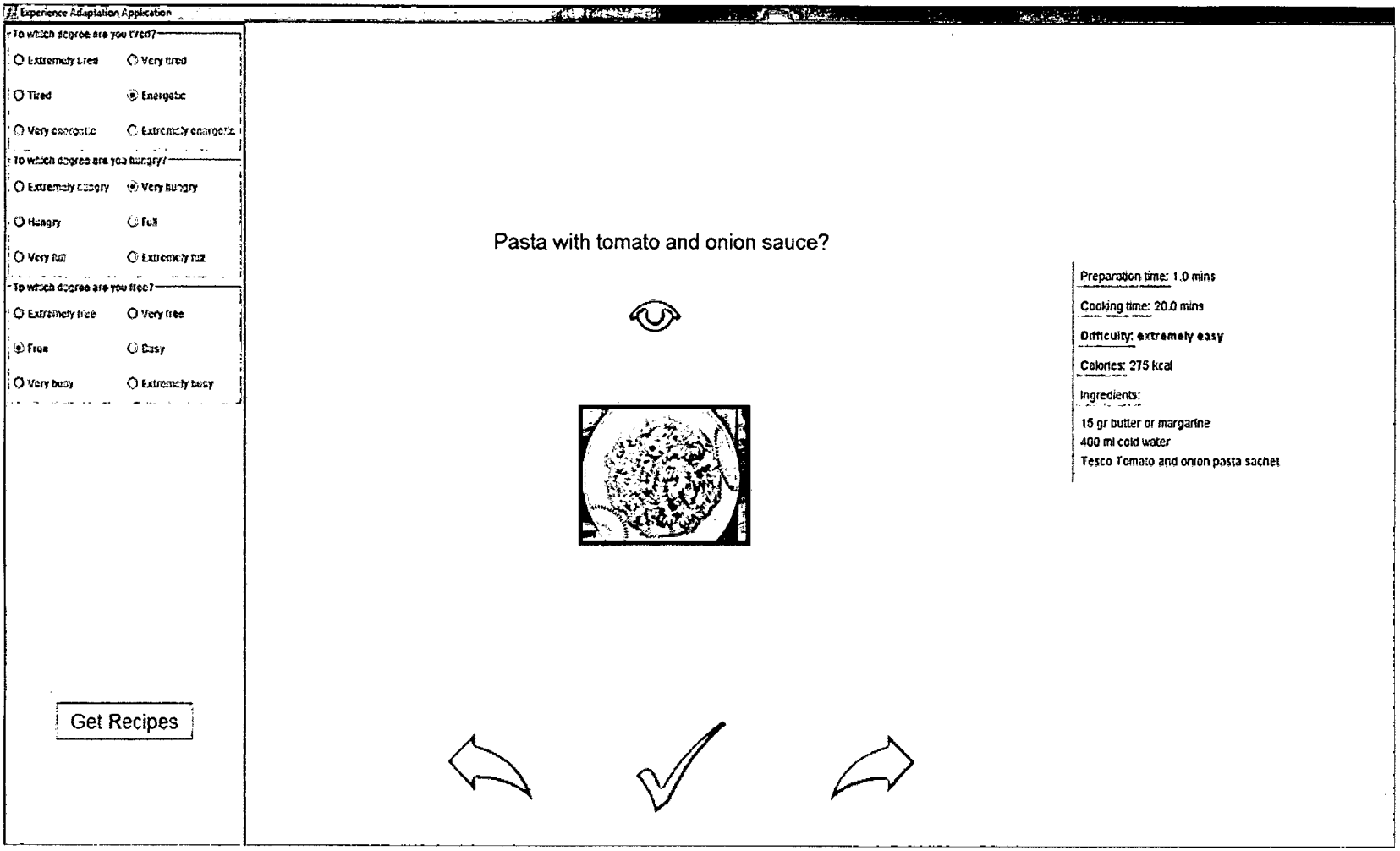
Figure 23C:
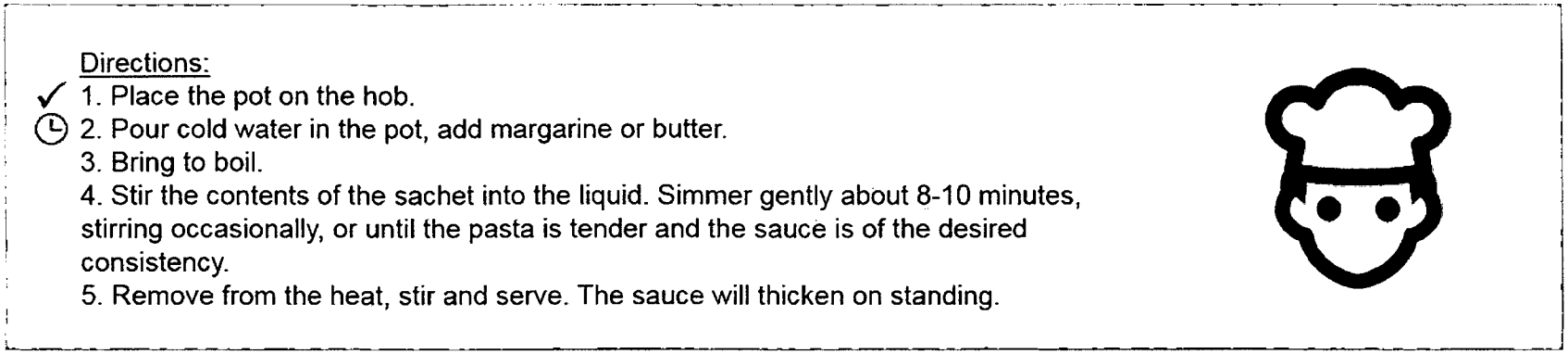
Figure 23D:
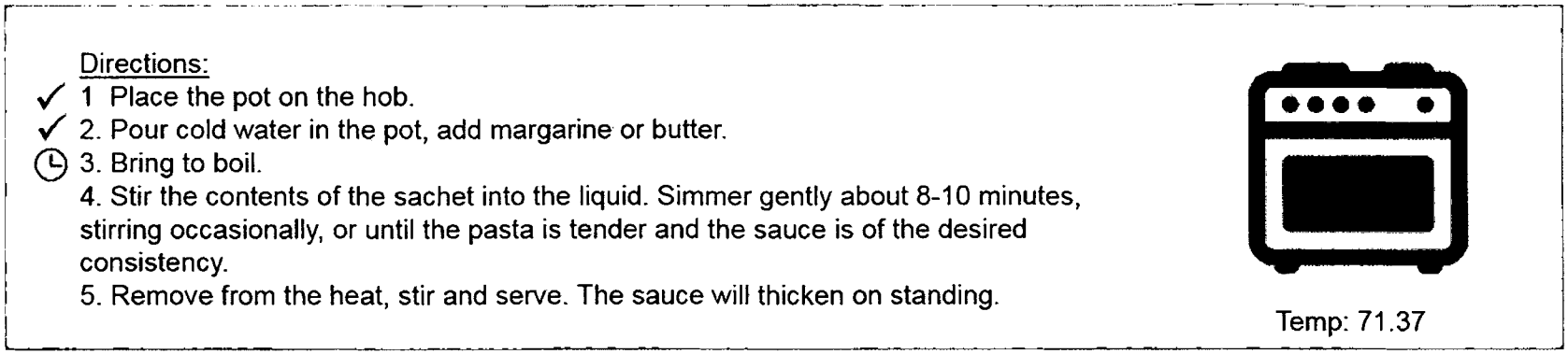

The integration in the AIFPS combines the two above-mentioned systems in a way to facilitate automation in cooking, to ensure health and safety requirements are met, to save energy as well as time and to increase the comfort levels of the user. The CWWs-based platform for recommending recipes provides recipes which are spoken by the Dialogue System in a specially designed laboratory, designated iSpace, for voice interaction (especially aiding those with disabilities including vision impairment) and are also shown on the GUI illustrated in FIG. 23*a*. The navigation of the recipes is done using voice to allow for a more natural interaction between the AIFPS and the user. After the user selects a recipe to cook, the instructions of that recipe are displayed on the GUI (FIG. 23*b*) and are also spoken by the AIFPS one by one. The AIFPS differentiates between the instructions that will need to be done by the user (such as placing the pan/pot on the hob, chopping the ingredients and adding the food to the pan/pot), and the instructions that will be sent to the iHob for automated, healthy and safe cooking. FIGS. 23*c* and 23*d* show the different signs on the GUI when the user intervention is required and when the iHob is in operation, successively. It should be noted that when the iHob is in operation, the user cannot interfere with the system. Upon completion of the hob operation, the Dialogue System in the iSpace notifies the user that the operation is completed and communicates the next instruction to be performed in the recipe. Hence, while the iHob is in operation, the user can attend to other matters as the AIFPS will notify whenever user intervention is needed thereby saving time and increasing the comfort levels of the user.

Figure 23E:
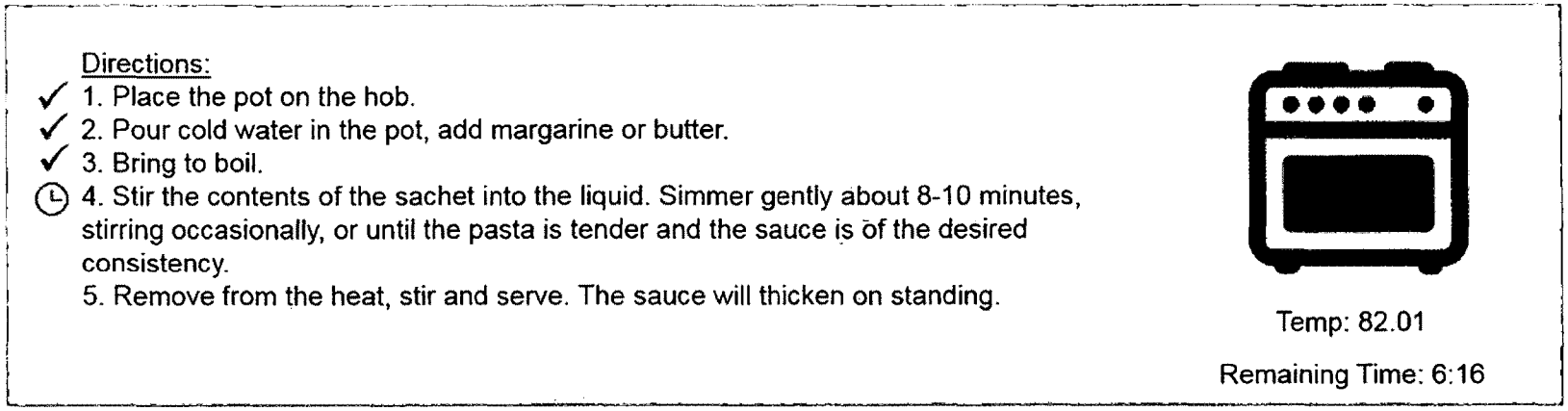
Figure 23F:
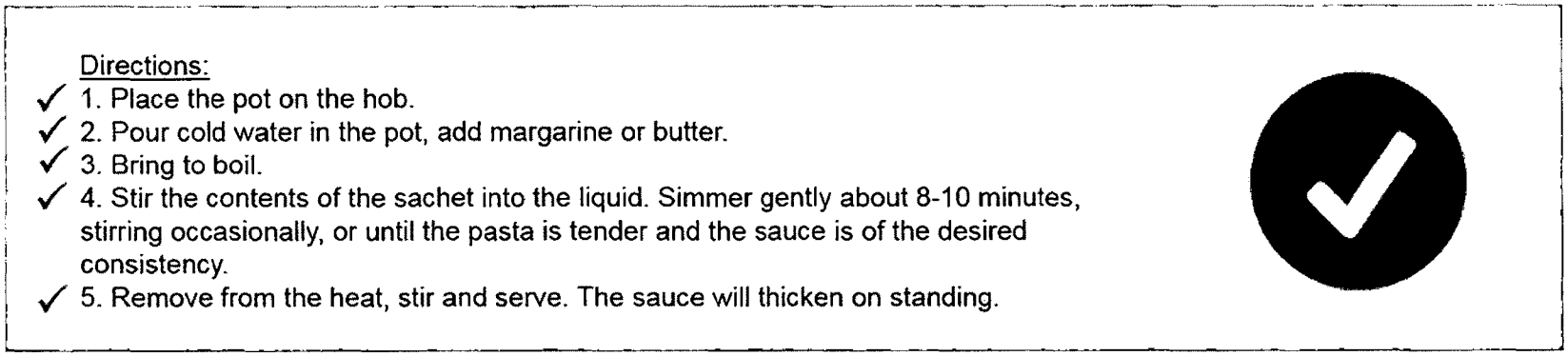
Figure 24A:
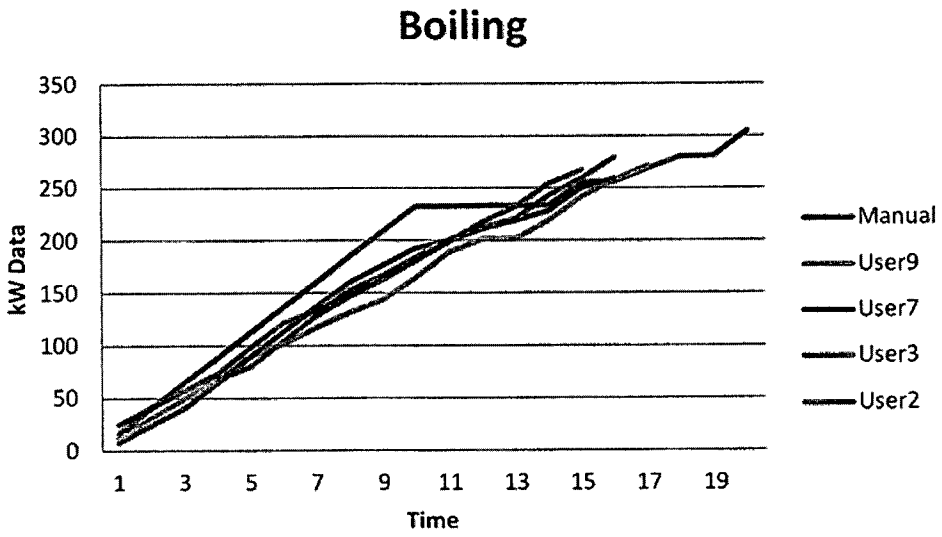
FIGS. 24*a*-24*d* show energy readings when cooking foodstuffs.
Figure 24B:
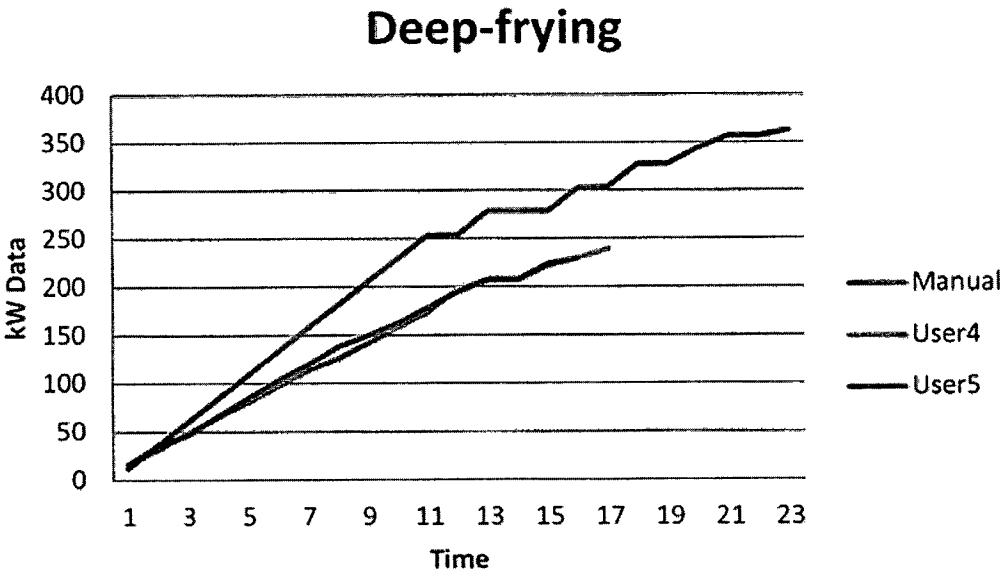
Figure 24C:
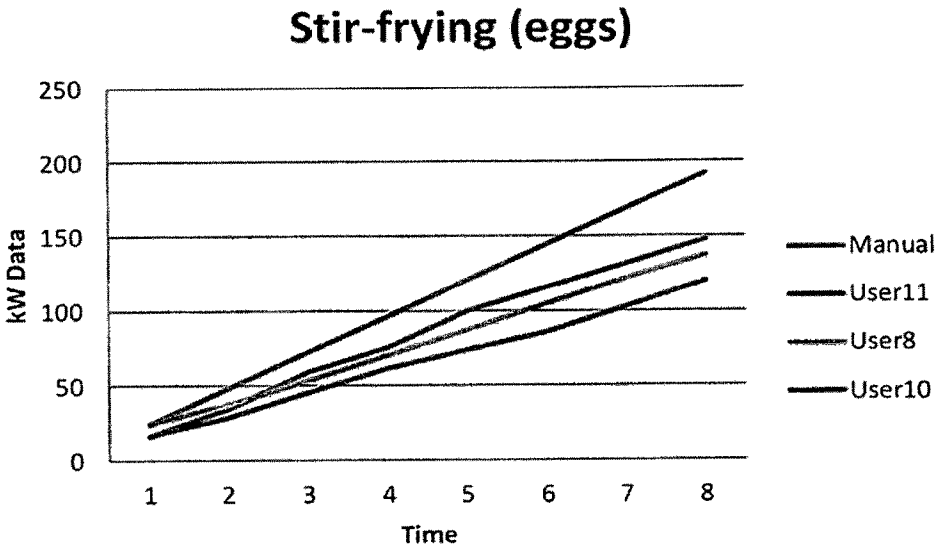
Figure 24D:
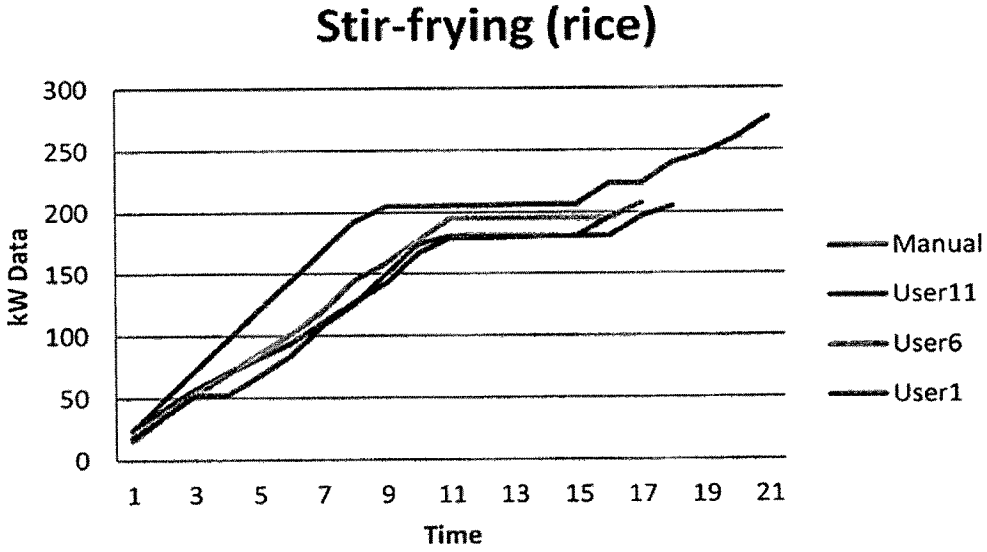

The integration in AIFPS also analyses the instructions and differentiates between different cooking techniques including boiling, deep-frying and stir-frying. The iHob operation requires the user to set the cooking time, specify the type of oil/fat used (for deep-frying) and the type of the pan (for stir-frying). For each recipe, cooking time and the type of oil/fat used are automatically set by the AIFPS. Also, the iSpace kitchen inventory is already known and hence the type of the pan is automatically set by the AIFPS. The AIFPS provides information about whether the boiling has started, whether the optimal frying temperature has been reached, the remaining cooking time (FIG. 23*e*), whether the user can add food to the pan/pot, and whether the cooking is finished (FIG. 23*f*).

In addition to semi-autonomous and safe cooking features of AIFPS, the system provides energy-efficiency for the realization of smart city concept. Various cooking techniques and various recipes with 11 participants having different backgrounds, hence different cooking attitudes have been performed. Additionally the energy recordings for manual cooking with the energy recordings for the iHob have been compared. Consequently, the average energy savings achieved according to the cooking techniques/recipes performed by various numbers of participants are as follows: for boiling pasta, average saving from 4 participants is found to be 11.5% with a standard deviation of 2.3%; for stir-frying eggs, average saving from 3 participants is found to be 25.5% with a standard deviation of 2.2%; for stir-frying rice, average saving from 3 participants is found to be 26.5% with a standard deviation of 1.7%; and for deep-frying potatoes, average saving from 2 participants is found to be 35.2% with a standard deviation of 1.2%.

The charts in FIG. 24 depict the cumulative energy readings versus time for different cooking techniques and recipes done by various users. The charts also show the efficient utilization of time, which is comparatively less than the amount of time spent in manual cooking. For example, manual deep-frying potatoes took 23 minutes whereas iHob delivers the frying process in 17 minutes while making sure that the smoking point of the oil used is not exceeded. Hence, the user can save 6 minutes which is not only a better time management (more than 26% time saving) but also a prevention of unnecessary energy use. It can be seen from the charts in FIG. 24 that experiments with manual hob operation required more energy in total compared to those with iHob operation (labeled as User followed by number). Consequently, with the use of AIFPS, energy savings of between 11.5% and 35.2% of energy saving have been recorded in the experiments conducted with different recipes and different cooking techniques.

Figure 25A:
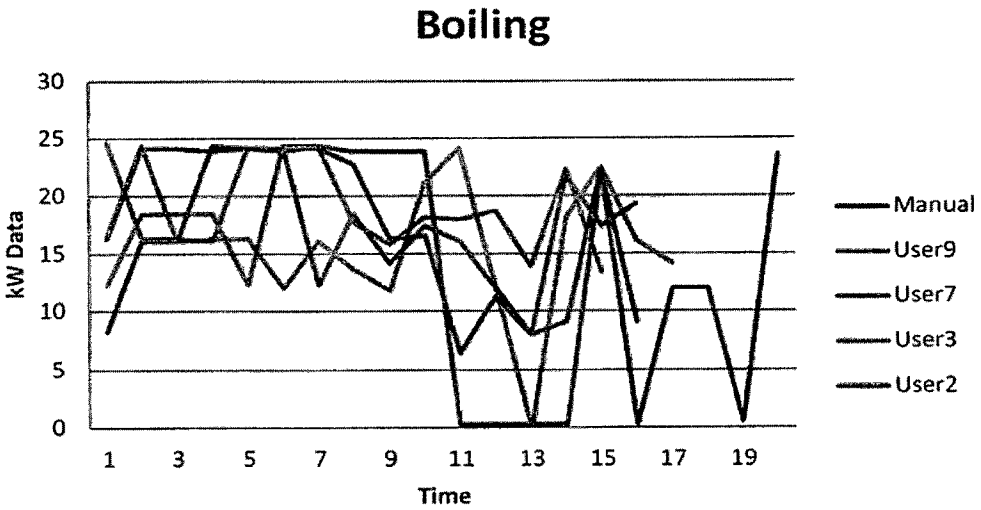
Figure 25B:
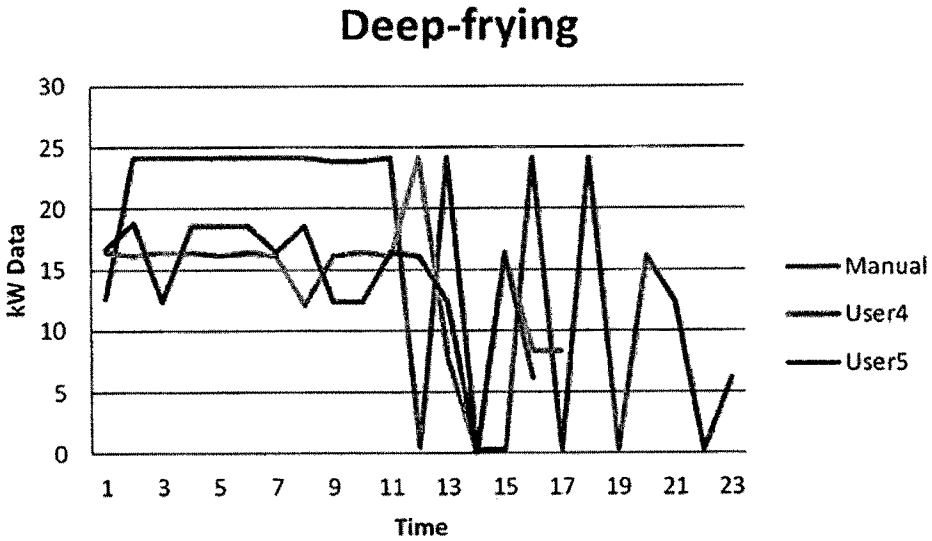

The charts in FIG. 25 depict the energy readings versus time for different cooking techniques and recipes done by various users. For example, FIG. 25*b* illustrates that at the 5th minute of deep-frying process, the manual operation of the hob requires ~25 kW of energy whereas the iHob operation performed by User4 requires ~16 kW of energy. The charts in FIG. 25 also support the efficient utilization of time, which is comparatively less than the amount of time spent in manual cooking. Additionally, the fluctuations in the charts in FIG. 25 for both experiments with manual hob operation and those with iHob operation (labeled as User followed by number) can be compared. The manual experiments involve the cook's experience on operating the hob manually by switching on and off. Also, similar patterns of switching on and switching off can be seen with the use of AIFPS. Consequently, by using AIFPS, it is possible to achieve even better (in terms of health and timing) food preparation results regardless of recipes and cooking techniques.

The invention claimed is:

1. A cooker hotplate control system, to heat to and maintain a cooking medium comprising water and/or a foodstuff distributed in water at or around the boiling point of water when using an electric hotplate, the system comprising;

a dimmer to govern power input to an electric hotplate to heat a hotplate;

a temperature sensor to determine the temperature of a hotplate;

an infrared sensor spatially separated from and to detect infrared radiation emitted by a cooking medium or a vessel containing a cooking medium on a hotplate; a first processor to determine the temperature of a cooking medium or a vessel from the detected infrared radiation and a first data storage means to store said data;

a second processor, the second processor calculating the first and second time derivatives of the temperature data;

a first fuzzy logic controller receiving as input the first and second time-derivative data from the second processor and producing an output to the dimmer, said output governing the amount of power supplied to a hotplate, the first fuzzy logic controller being active to bring a cooking medium temperature up to the boiling point and to hold a cooking medium at the boiling point for a defined time period; a second fuzzy logic controller, once the defined time period has ended, to maintain the temperature within a defined temperature range about the boiling point, the first and second fuzzy logic systems acting sequentially.

2. A system according to claim 1, wherein parameters of the first fuzzy logic controller are determined within the first 30 seconds of heating with power to a hotplate set to full.

3. A system according to claim 1, wherein the system includes a laser distance detector to detect the presence of a vessel on a hotplate.

4. A system according to claim 1, wherein the infrared sensor is set at a distance of 25 to 35 cm from a vessel on a hotplate.

5. A system according to claim 1, wherein the distance is around 30 cm.

6. A system according to claim 1, wherein the second fuzzy logic controller is activated only when the first temperature time derivative is steady for a preset period.

7. A system according to claim 6, wherein the preset period is 30s.

8. A system according to claim 1, wherein the output of the first or second fuzzy logic controller is supplied to a fuzzy logic system whose output governs the power supply controller, which output has two levels, full or zero.

9. A system according to claim 1, wherein the fuzzy logic system acts to maintain a temperature differential of 100 to 120° C. between a hotplate temperature and a cooking medium on the hotplate.

10. A system according to claim 1, wherein the fuzzy logic system acts to maintain a temperature difference of 30-50° C. between a hotplate temperature and a cooking medium on the hotplate.

11. A system according to claim 10, wherein the dimmer provides zero power to the hotplate when the temperature difference is greater than 50° C.

12. A system according to claim 1, wherein the first fuzzy logic system is activated and the second fuzzy logic controller is deactivated if the temperature is more than 15° C. below the boiling point.

13. A system according to claim 1, wherein the system includes a power cut-out in the event the temperature determined by the infrared sensor exceeds 105° C.

14. A system according to claim 1, wherein fuzzy logic controllers and the fuzzy logic system are mamdani fuzzy logic controllers and fuzzy logic systems employing a maximum inference and a centre of sets and de-fuzzification.

15. A system according to claim 1, wherein the hotplate temperature sensor measures the temperature of a lateral edge of a hotplate.

16. A system according to claim 1, wherein the system includes a warning means should a hotplate temperature be greater than 40° C.

17. A system according to claim 1, wherein control of the system by a user is through a graphic user interface.

18. A system according to claim 1, wherein a user communicates with the system through voice commands and a computing with words architecture.

19. A system according to claim 18, wherein the commands are processed using linear general type-2 fuzzy logic methodology.

20. A system according to claim 19, wherein a general Type-2 fuzzy logic methodology is used.

21. A cooker hotplate control system, to heat to and maintain a cooking medium comprising a cooking oil and/or a foodstuff distributed in an oil at or around a requested frying temperature when using an electric hotplate, the system comprising;

input means enabling a user to input a cooking oil or vessel type and a desired cooking temperature;

a dimmer to govern power input to an electric hotplate to heat a hotplate;

a temperature sensor to determine the temperature of a hotplate;

an infrared sensor spatially separated from and to detect infrared radiation emitted by a cooking medium or a vessel containing a cooking medium on a hotplate;

the system including a look-up table of emissivity values for vessels and for cooking oils, which values are processed by the first processor to determine the actual temperature of a foodstuff;

a first processor to determine the actual temperature of a cooking medium or a vessel from the detected infrared radiation and a first data storage means to store the actual temperature;

a second processor to calculate the difference between the frying temperature and the actual temperature;

a third processor calculating the first time derivative of the temperature difference data obtained from the second processor;

a first fuzzy logic controller receiving as input the first time-derivative data from the third processor and the output of the second processor;

and producing an output to the dimmer, said output governing the amount of power supplied to a hotplate, the first fuzzy logic controller being active to bring a cooking medium temperature up to the frying temperature and to hold a cooking medium at the frying temperature for a defined time period;

a data storage module to store the target temperature of the hotplate when a cooking medium reaches the frying temperature;

a second fuzzy logic controller to maintain the temperature of a cooking medium within a defined temperature range about the frying temperature the second fuzzy logic controller receiving as input the target temperature and producing an output to the dimmer, said output governing the amount of power supplied to a hotplate;

the first and second fuzzy logic systems acting sequentially.

22. A system according to claim 21, wherein the system includes a power cut-out means in the event the temperature of a foodstuff is determined to be greater than 250° C.

23. A system according to claim 21, wherein the system further includes a buffer to store the most recent temperature determinations to check if a rapid increase in temperature is occurring.

24. A system according to claim 23, wherein said buffer contains the previous twenty temperature determinations.

25. A system according to claim 21, wherein the hotplate temperature sensor measures the temperature of a lateral edge of a hotplate.

26. A system according to claim 21, wherein the system includes a warning means should a hotplate temperature be greater than 40° C.

27. A system according to claim 21, wherein control of the system by a user is through a graphic user interface.

28. A system according to claim 21, wherein a user communicates with the system through voice commands and a computing with words architecture.

29. A system according to claim 28, wherein the commands are processed using linear general type-2 fuzzy logic methodology.

30. A system according to claim 29, wherein a general Type-2 fuzzy logic methodology is used.

* * * * *